US007703703B2

(12) United States Patent
Gavin

(10) Patent No.: US 7,703,703 B2
(45) Date of Patent: Apr. 27, 2010

(54) RESERVOIR AND SPRAY APPLICATOR

(76) Inventor: Daniel J. Gavin, 32304 Acacia Ct., Avon Lake, OH (US) 44012

( * ) Notice: Subject to any disclaimer, the term of this patent is extended or adjusted under 35 U.S.C. 154(b) by 88 days.

(21) Appl. No.: 11/971,862

(22) Filed: Jan. 9, 2008

(65) Prior Publication Data

US 2009/0173806 A1 Jul. 9, 2009

(51) Int. Cl.
*B05B 7/28* (2006.01)
*B05B 1/26* (2006.01)

(52) U.S. Cl. ..... 239/317; 239/310; 239/500; 239/521; 239/522

(58) Field of Classification Search ..... 239/310, 239/317, 318, 340, 343, 432, 499, 500–502, 239/521–524
See application file for complete search history.

(56) References Cited

U.S. PATENT DOCUMENTS

| | | | | |
|---|---|---|---|---|
| 1,179,905 | A | 4/1916 | Englemann | |
| 1,769,428 | A | 7/1930 | Gatchet | |
| 1,848,708 | A | 3/1932 | Gatchet | |
| 1,976,506 | A | 10/1934 | Maurer | |
| 2,536,361 | A | 1/1951 | Flanders | |
| 2,601,672 | A | 6/1952 | Gatchet | |
| 2,682,428 | A | 6/1954 | Roberts | |
| 2,789,010 | A | 4/1957 | Dean | |
| 2,991,939 | A | 7/1961 | Packard | |
| 3,123,362 | A | 3/1964 | Elvers, Sr. | |
| 3,165,114 | A | 1/1965 | Garret | |
| 3,254,844 | A | 6/1966 | Blasnik et al. | |
| 3,323,685 | A | 6/1967 | Schultz | |
| 3,421,738 | A | 1/1969 | Dulger | |
| 4,067,498 | A | 1/1978 | Holcomb | |
| 4,809,913 | A | 3/1989 | Gunlock | |
| 4,913,356 | A | 4/1990 | Gunlock | |
| 5,100,059 | A * | 3/1992 | Englhard et al. | 239/310 |
| 5,183,206 | A * | 2/1993 | Gavin | 239/317 |
| 5,601,211 | A * | 2/1997 | Foster | 222/143 |
| 5,609,299 | A * | 3/1997 | Foster et al. | 239/304 |
| 6,869,028 | B2 * | 3/2005 | Bartsch et al. | 239/315 |
| 7,118,049 | B2 * | 10/2006 | Dodd | 239/318 |
| 7,207,497 | B2 * | 4/2007 | Clark | 239/1 |
| 7,513,442 | B2 * | 4/2009 | Dodd | 239/310 |
| 2003/0192964 | A1 * | 10/2003 | Foster et al. | 239/525 |

* cited by examiner

*Primary Examiner*—Len Tran
*Assistant Examiner*—James S Hogan
(74) *Attorney, Agent, or Firm*—Woodling, Krost and Rust

(57) ABSTRACT

An apparatus for spraying lawn products adapted for use with a fluid supply source and a reservoir includes a housing defining a mixing chamber therein and a reservoir coupled to the housing. A process for use of the apparatus is also disclosed. The housing includes a substantially cylindrically shaped cap portion having discontinuous internal threads forming flats therein, a lip portion, and an open end portion. The reservoir includes a generally cylindrically shaped neck portion having a partial exterior shoulder, external threads thereon, and an end portion. Internal threads of the neck portion of the reservoir interengage the discontinuous internal threads having flats therein of the cap portion. The partial exterior shoulder of the reservoir interengages the open end portion of the cap portion such that the end portion of the neck of the reservoir does not engage the lip portion of the cap portion aspirating of the reservoir and housing.

6 Claims, 20 Drawing Sheets

RESERVOIR AND SPRAY APPLICATOR

FIELD OF THE INVENTION

The present invention relates to the art of liquid spray applicators and more particularly to liquid seed applicators.

BACKGROUND OF THE INVENTION

U.S. Pat. No. 5,183,206 to Gavin is incorporated herein by reference and is substantially copied herein and quoted below, in this, the BACKGROUND OF THE INVENTION, section of the instant patent application. FIGS. 1-8 are duplicates from U.S. Pat. No. 5,183,206 and FIG. 11 is a view of the related art cover (spray applicator) 12.

U.S. Pat. No. 5,183,206 to Gavin, quoted below, is incorporated herein by reference and states, in pertinent part:

". . . an inlet chamber is typically provided for receiving an input fluid flow from a source such as a garden hose. The inlet chambers are typically provided with two exhaust passages including an approach passage having a reduced cross-sectional area and a smaller passage forming an inlet into a reservoir containing seed. The approach passage in turn connects the inlet chamber with a mixing chamber. Within the mixing chamber, the slurry created by the inputted fluid received through the smaller passage and combined with the seed is mixed with the inputted fluid which flows through the approach passage. Lastly downstream, a nozzle is provided for limited control over the resultant spray pattern."

". . . a convertible spray nozzle is provided for application of both soluble and non-soluble materials over a surface. The convertible spray nozzle comprises an inlet end, a distribution section, a mixing section, and an exhaust end. Fluid, such as water, is received into a primary chamber located at the inlet end. The inputted fluid is then divided into two partial flows while within the distribution section. The first partial flow is directed to a canister coupled to the nozzle and provided with the soluble or non-soluble application materials. The second partial flow is directed to a mixing chamber. The mixing chamber is open to the slurry created within the canister whereby the passing of the second partial flow through the mixing chamber draws the slurry from the canister and through an outletchannel for distribution at the exhaust end taking advantage of the venturi principles . . . ."

". . . the distribution section is provided with a direct fluid passage for permitting the fluids received into the secondary inlet chamber to pass therethrough confined within a predetermined longitudinal cross-sectional area. Further, the mixing section is provided with an outlet channel formed above the predetermined longitudinal cross-sectional area of fluid flow through the direct passage. An outlet channel deflector substantially deflects the portions of the fluid flow obliquely through the mixing chamber against a bottom surface of a flared nose provided at the exhaust end of the spray nozzle."

". . . a pair of discs are provided for easy conversion between soluble and non-soluble applications. A stationary disc is received into the spray nozzle housing to partially restrict a passage between the canister and the mixing chamber. The stationary disc is further provided with centering holes for receipt of positioning dimples formed on a movable . . . . The movable disc is apertured having a plurality of outflow orifices of varying size to control the passage between the reservoir and the mixing chamber by means of modifying the cross-sectional area of the passage to "throttle" the flow therethrough."

". . . a method of mixing and spraying non-soluble particles using a spray nozzle is provided. A preselected ratio of an inputted fluid stream is constrained to flow through a mixing chamber and directly into an output channel deflector to thereby be deflected through an outlet channel after mixedly combining with portions of a slurry created within the mixing chamber itself. An exhaust end having a flared nose comprising guide ribs and a bottom surface creates an even flow for uniform seed distribution."

". . . the FIGURES show a convertible spray nozzle apparatus 10 capable of receiving a canister or jar 16 and a fluid supply as, for example, a garden hose 18."

"More particularly with reference to FIG. 1, the convertible spray nozzle 10 is generally divided into four regions A, B, C, D. The inlet end A is adapted to receive a garden hose 18 or the like for supply of fluids such as water. An internally threaded nut 22 is received over a flared end of the spray nozzle. The distribution section B and mixing section C combine to form channels which first divide the inputted fluid into at least two partial flows and subsequently downstream recombine the divided flows along with soluble or non-soluble products from within the canister 16. The expelled combination flows through the exhaust end which forms a flared nose for control over the width of exhaust spray."

"Now with particular reference to FIG. 2, the convertible spray nozzle 10 of the instant invention is shown in an exploded view along line 2-2 of FIG. 1 to expose the constituent components. The inlet end section A contains a number of individual valving parts for control over the inputted fluid stream. Fluid enters the spray nozzle from the right side as viewed from FIG. 2 through a one-way (uni-directional flow) valve 20. To guard against backflow into the supply fluid line and to meet code requirements in certain states, a "raspberry" valve is typically used. The raspberry valve permits the flow of fluid into the housing 11 when the pressure to the right of the valve is greater than the pressure to the left of the valve as viewed in the FIGURE. The valve 20 comprises a small slit for the passage of water therethrough, the material surrounding the slit being resiliently biased toward the closed position wherein, absent any pressure differentials, the valve slit denies the flow of fluids therethrough. A backpressure, manifested as an increasing pressure differential gradient toward the left as viewed in the FIGURE, causes the material of the valve to close the slit with a pressure greater than what exists in accordance with the bias of the material itself."

"A plunger 26 is adapted to receive an O-ring 28 into a circumferential groove 29. In addition, a pair of larger circumferential grooves 25 are adapted to receive an O-ring pair 24 onto the plunger 26. The O-rings 24, 28 and plunger 26 are sized to be slideably received within a primary inlet chamber 32 of housing 11. When received as such within the chamber 32, the O-rings 24 engage the inner walls of the primary inlet chamber itself to block the flow of water around the plunger as between the plunger 26 itself and the primary inlet chamber walls. At an end of the plunger 26, O-ring 28 is accordingly sized to engage the inner walls of a secondary inlet chamber 34 when positioned to the extreme left as viewed from the FIGURE. When in such position, the combination of plunger 26 and O-ring 28, deny flow of fluids from the primary inlet chamber 32 into the secondary inlet chamber 34."

"With continued reference to the inlet end section A, a portion of a trigger 30 passes through the housing 11 to engage a recess 27 within the plunger 26. Actuation of the trigger 30, as by a toggle action, serves to slide the plunger assembly 26 longitudinally within the primary inlet chamber 32. Actuation of the trigger 30 in a direction F causes the plunger assembly 26 to slide within the primary inlet chamber 32 leftwardly as viewed in the FIGURE. This has the effect of closing off fluid flow through the secondary inlet chamber 34.

Conversely, actuation of the trigger 30 in a direction E longitudinally slides the plunger 26 rightwardly as viewed in the FIGURE to open or allow fluid flow into the secondary inlet chamber 34 through perforations in the plunger 26 spaced radially outward from the O-ring 28 and extending longitudinally through the plunger body."

"An internally threaded nut 22 mechanically attaches a fluid supply hose such as a garden hose to the housing 11. The nut 22 grips the housing 11 by means of a ridge 23 circumferentially provided on the housing 11 as illustrated."

"Referring next to the distribution section B, the secondary inlet chamber 34 forms an elongate generally cylindrical hollow section having a longitudinal axis CL, which is collinear with a longitudinal axis of the primary inlet chamber 32 in the preferred embodiment. However, the secondary chamber 34 is of considerably smaller cross-sectional area than the primary chamber, as can be seen from the FIGURE. Fluid flowing into the secondary chamber 34 escapes through one of two openings. A fill passage 38 comprises a small capillary-type passageway which directs the fluid from the secondary inlet chamber 34 into a canister (not shown) received into the housing 11 and coupled thereto as by threads 15. A direct passage 40 forms the second opening and is constrained to lie below the longitudinal axis CL of both chambers 32 and 34 as viewed from the FIGURE. Generally, fluid flowing through the secondary inlet chamber 34 exists the direct passage 40 as a directed spray according to the size of the opening 40 and below the axis CL of the inlet chambers 32 and 34. Fluid which flows through the fill passage 38 mixes with seed or other materials or substances which may be contained in the canister 16 to create a slurry."

"The axis CL is used for ease of reference in the preferred embodiment, although it is to be understood by those skilled in the art that the relative positioning between the direct passage 40 and a deflector/outlet channel pair described below is primarily responsible for the advantageous results realized by the instant invention."

"Next referring to the mixing section C, fluid which passes through the direct passage 40 enters a mixing chamber 36 striking an outlet channel deflector surface 52. The flow of fluid through the mixing chamber 36 and across a slurry communicating passage 54, creates a venturi effect which tends to draw the slurry present within the canister 16 into the mixing chamber 36 according to the well-known phenomenon described above. The outlet channel deflector 52 is set at an angle from the longitudinal axis above the uppermost extreme of passage 40 and common to the inlet chambers 32 and 34. The angle is 45.degree. in the preferred embodiment. In addition, the outlet channel 50 and outlet channel deflector 52, meet at a plane defined by the longitudinal axis CL to, in effect, create a "misalignment" between the direct passage 40 and outlet channel 50. That is, fluids escaping the secondary inlet chamber 34 through the direct passage 40, must necessarily first strike the outlet channel deflector 52, before passing through the outlet channel 50. As such, it is apparent that the actual configuration of the chambers 32 and 34 may be modified to conform with any number of applications without departing from the misalignment concept described above."

"In addition, the cross-sectional area of the secondary chamber 34 in a plane transverse to the axis CL is "tuned" with the area of outlet channel 50. That is, in the preferred embodiment, the chamber 34 and the channel 50 are sized to have corresponding (matching) cross-sectional areas. This arrangement results in the optimum operational characteristics in the preferred embodiment. Experimentation with sizing indicates that for a fixed cross-sectional area of secondary chamber 34, a large outlet channel 50 resulted in a "gasping" or "sputtering" of the product from the reservoir 16. For a small outlet channel 50, the inputted fluid accumulates within the reservoir 16 in turn causing threads 15 to leak the accumulated slurry."

"The quantity and capacity of the expulsion of the slurry contained within the canister 16 is controlled by a selective adjustment of the slurry communicating passage 54. In the preferred embodiment, a means for controlling the aperture size of the slurry communicating passage 54 comprise a stationary disc 60 and a moveable disc 70."

"With continued reference to FIG. 2, but more particularly with reference to FIGS. 6 and 7 which illustrate views taken along line 6-6 and 7-7 of FIG. 2, respectively, the stationary disc 60 comprises an output orifice 61, a mushroomed center 62, a retainer ridge 63, an orientation clearance 64, a socket 66, and positioning holes 68. The output orifice 61 is selected to determine the absolute maximum size of the slurry communicating passage 54 for all conceivable applications of the spray nozzle. As can be seen in FIG. 2, the housing 11 is adapted to receive the stationary disc 60 over the fill passage wall 39 and up into the rim 14 past the internal threads 15. The stationary disc 60 is provided with an orientation clearance 64 through which the fill passage wall 39 extends. An integral socket 66 mates with a corresponding integral male part formed on the housing 11 to ensure that the stationary disc 60 is properly oriented. A mushroomed center 62 provides for easy manual manipulation of the stationary disc for removal or the like. The stationary disc itself is adapted to receive the movable disc 70 by means of a retainer ridge 63 and centering holes 68."

"With the stationary disc 60 received into the housing 11 and oriented according to the orientation criteria established by the socket 66, the moveable disc 70 may then be installed into the housing 11 abutted against the stationary disc 60. The moveable disc 70 is provided with a plurality of outflow orifices 72, dimples 74, tabs 76, and an internal centering frictional surface 78. The dimples 74 are positioned about the moveable disc 70 to correspond with the positioning holes 68 provided in the stationary disc 60. As illustrated, the preferred embodiment comprises four hole/dimple sets, to provide for four individual orientations of the moveable disc 70 about an axis loosely defined by the fill passage 38. As can be seen from the FIGURES, the surface 78 is sized to frictionally engage the retainer ridge 63 and in this manner is held thereby during attachment of reservoir 16 to the spray nozzle. Actual control over the resultant size of the slurry communicating passage 54 is controlled by a combination of the output orifice 61 and selection of a one of the plurality of outflow orifices 72. As seen in the FIGURES, the outflow orifices 72 may be sized and numbered according to a wide variety of particular applications. That is, it is possible to provide a single large outflow orifice, or a plurality of small orifices, or any combination thereof, to achieve a desired slurry outflow characteristic."

"However, it is to be noted that the spray nozzle 10, as illustrated, functions to disperse both soluble and non-soluble products from the reservoir even without the use of either the discs 60 or 70. As would be expected, of course, without the expedient of the discs 60, 70 to govern the flow of the concentrated product, soluble substances are expelled from the nozzle and applied over the desired surface rather quickly, as to make use of the device without the control provided by the discs 60, 70 to be unwise."

"In operation, a single large outflow orifice is manually selected through use of tabs 76 by rotating the moveable disc 70 about the fill passage axis until the dimples 74 engage the positioning holes 68. In that orientation, a slurry comprising grass seed and water may be applied to a surface. A small outflow orifice 72 for spreading soluble products is possible by manually rotating the moveable disc 70 in quarter-turn increments where the dimples 74 mate with the positioning holes 68. Through this simple expedient, the spray nozzle is easily convertible in the field for use with both soluble and non-soluble products presented within the canister 16. In addition, both discs are easily removable for cleaning or the like."

"Referring next to FIG. 3, the spray nozzle of the preferred embodiment is illustrated with the moveable disc 70 removed. As can be seen in the FIGURE, the mixing chamber 36 is formed by a combination of mixing chamber walls 42, cover 12, and portions of the stationary disc 60. A passage into the mixing chamber is provided by the output orifice 61 of the stationary disc. Control over the size of the passage is possible with the moveable disc 70 as is described above."

"With continued reference to FIG. 3, the exhaust end D of the spray nozzle comprises a flared nose so, having guide ribs 82, and a bottom surface 84. The guide ribs 82 are formed to be separated by a gap near the mixing chamber and to protrude forward at an angle from the mixing chamber such that the two ribs are separated by a greater gap at their tips furthest from the housing. The guide ribs forming the flared nose define an angle alpha, which in the preferred embodiment is approximately 25. degree."

"Referring next to FIGS. 4 and 5, taken on the lines 4-4 and 5-5 of FIG. 3, respectively, the unique positioning of the direct passage 40 and outlet channel 50 of the preferred embodiment will be described. Referring first to FIG. 4, a first end of the mixing chamber 36 is illustrated being formed in part by the cover 12, mixing chamber walls 42, and the housing 11. As can be seen in the FIGURE, the direct passage 40 is configured in a "half-moon" shape in the preferred embodiment. The direct passage 40 opens into the mixing chamber 36 below the longitudinal axis CL."

"Referring next to FIG. 5, a second end of the mixing chamber 36 is shown being formed in part by the cover 12, the mixing chamber walls 42, and the housing 11. The outlet channel 50 provides an exhaust opening from the mixing chamber 36 above the longitudinal axis CL. Outlet channel deflector 52 extends away from the longitudinal axis CL a distance at least as large as that by which the direct passage 40 extends from the longitudinal axis CL, as illustrated in FIG. 4."

"By the arrangement of the direct passage and outlet channel as described above, fluid exiting the secondary inlet chamber 34 through the direct passage 40 necessarily strikes the outlet channel deflector 52 formed to lie in a direct path distanced from and parallel with the longitudinal axis CL. A plane H is defined by the longitudinal axis CL illustrated in FIGS. 4 and 5 and substantially perpendicular with the fill passage 38. The direct passage 40 and the outlet channel 50 are constrained to lie on opposite sides of plane H."

"With reference next to FIG. 8, the general flow of fluids through the spray nozzle will be described with respect to the preferred embodiment. A first flow is received from a fluid supply source into the primary inlet chamber 32. From the primary inlet chamber 32, the first fluid enters a secondary inlet chamber 34, the inlet chambers being aligned on a common longitudinal axis CL. The fill passage 38 communicates a first portion of the first fluid from the secondary inlet chamber 34 into canister 16. The direct passage 40 communicates a second portion of the first fluid from the secondary inlet chamber 34 into the mixing chamber 36. The second portion of the first fluid is substantially directed by the direct passage against the outlet channel deflector 52. The movement of the second portion of the first fluid flow across the slurry communicating passage 54 draws the slurry into the mixing chamber 36 as a mixed composition flow F.sub.s according to the venturi effect."

"The outlet channel deflector 52 creates a constant turbulence of the fluids in and near the mixing chamber 36. Some of the turbulence is due in part to flows from the mixing chamber 36 into reservoir 16. Overall, the turbulence performs at least two beneficial functions. First, the progress of the material from the reservoir 16 and out channel 50 is held in check for better control over the concentration of the material applied to the desired spray surface area. Also, the turbulence prevents a "bunching" up of non-soluble products within the mixing chamber 36 which would tend to clog the nozzle."

"The mixture exiting mixing chamber 36 through outlet channel 50 is substantially directed by the reflected fluid flow from the outlet channel deflector 52. As such, the bottom surface 84 of the flared nose 80 provides a second reflecting surface against which the mixture exiting the spray nozzle is guided. Further, the guide ribs 82 comprising the flared nose 80 determine the "spread" of the mixture exiting the spray nozzle 10. This "doubly reflected" fluid flow according to the inherent misalignment between the direct passage 40 and the outlet channel 50 prevents clogging of the mixing chamber 36 and accommodates a uniform distribution of the expelled fluids."

"Removal of the flared nose 80 results in a fluid exhaust substantially parallel to the plane defined by the surface 52. But for the nose 80, the expelled fluid flow would generally follow the direction illustrated as F.sub.N."

FIG. 9 is a side view 900 of a prior art Miracle Gro® spray applicator comprising a thick and rigid plastic bottle 902 spray housing 901, inlet 903 and outlet 904. Inlet 903 is adaptable for use with a typical garden hose. Outlet 904 is adaptable for use with a diffusion spraying device such as a sprinkler head (not shown).

FIG. 10 is a partial cut-away view 1000 of the prior art Miracle Gro® spray applicator illustrated in FIG. 9. FIG. 10 illustrates the sealing of the rigid plastic bottle 902 against the elastomeric seal 912. Specifically, the neck of the bottle 906 includes exterior threads 908 which interengage with internal threads 907 on an interior wall 905 of the spray applicator 901. Elastomeric seal 911 is trapped by walls 909, 910 and 911 of the spray applicator.

The two most common sprayers being offered to the lawn and garden consumer are the siphoning style and the inflow style. The siphoning style uses the venturi effect to deliver product to the exiting orifice of the sprayer. In order to maintain the venturi these designs must have an air inflow to replace the product outflow and maintain the venturi effect. The inflow styles being offered purport to use a venturi to deliver product to the outflow orifice but in fact do not since these designs do not have an air inflow mechanism.

Neither the Gavin '206 patent quoted above nor other inflow type sprayers recognize the need for a strong venturi effect with an air intake to enable the venturi. The lack of a strong venturi causes malfunctions both in the application of the product and in the emptying process. Without airflow to replace the emitted product from the container the venturi effect is defeated.

Previous designs do not indicate any bottle neck ring design and do not indicate the manner in which the sprayer head is to be affixed to the container. In fact, as indicated above in connection with FIGS. 9 and 10, some of the designs in fact are sealed so that no air may enter the sprayer head or the container. These designs are typically made with full 360° threads for both the head and the container. When the head and container are combined they seal the jar (container) to prevent leaks from the threads during use. This sealing prevents airflow through the threads defeating the venturi. These designs utilize pressure applied into the container to force the product up and out of the container. However, there is a pressure imbalance across the body of the container. Without equalizing pressure inside and outside of the container, the container walls must be thick and rigid as disclosed above in connection with the Miracle Gro® spray applicator in FIGS. 9 and 10. The requirement to design heavy duty containers also limits the size of the container and creates additional cost. The force out design also prevents the units from emptying completely unless they are inverted (turned upside down) and the container is unscrewed one full turn from the sprayer head while the water pressure is on and the unit is upside-down usually causing a wet and annoyed user.

The Gavin '206 design without the disc assembly allows for proper air input only when not over tightened and does not disclose any way to prevent over tightening. The Gavin '206 design with the disc assembly will dispense slurry through the largest orifice (insoluble) when the threads are not tightened to seal air off. When the smaller orifice is used in the Gavin '206 and air is allowed to flow (i.e. threads are loosened), then pulsation and malfunction of the discharge occurs. In soluble position the disc assembly of the Gavin '206 design does not perform better than other soluble sprayers on the market.

FIG. 11 is a view 1100 of a prior art cover as illustrated in FIG. 1. Specifically, FIG. 11 is an interior view 1100 the of prior art spray applicator. Flats 1101 in threads 15 are illustrated as is the lip 1102 in the spray applicator. Reference numeral 1103 is the interior of the upper portion of the spray applicator. Reference numeral 1103A indicates the head portion of the housing or, put another way, the interior of the upper portion of the spray applicator. Reference numeral 1105 indicates the bottom lip (sometimes referred to herein as the open end portion) of the cap portion of the housing of the spray applicator. Reference numeral 1106 is the outer top of the spray applicator. Reference numeral 1109 is the male part for interengagement with socket 66 of a fixed disc to secure the fixed disc to the cap portion of the housing.

SUMMARY OF THE INVENTION

The invention protects against the defeat of the flow venturi formed in the flow channel passageways and orifices therein through the proper aspiration of the head portion of the cap portion of the housing and through the proper aspiration of the reservoir. Air is supplied to the head portion and the reservoir to prevent the defeat of the venturi.

The invention enables the venturi and allows for larger, thinner wall containers at less cost and greater volume without refilling which also saves time and labor. The invention allows the container to empty automatically when inverted without unscrewing or rotating the threads of the head and the container with pressure applied thereto. The invention includes a "stop" position on the bottle and the head so that the threads cannot be tightened to the point of sealing off air inflow which is accomplished through the flat areas spaced 90 degrees between the partial threads of the head. Additionally, the flat areas may extend past the lip in the cap portion of the housing in the event that the bottle is accidentally over-tightened or intentionally over-tightened. By allowing the air inflow the venturi effect draws the slurry up into the head for distribution and keeps an equalizing pressure in the container preventing distortion of a thin-walled container. The equalizing pressure also allows the container to empty automatically in the inverted position without rotating the threads as is required with the related art set forth in FIGS. 9 and 10.

The invention includes a stationary or fixed disc having eight (8) orifices or apertures. Four of the orifices are rectangularly shaped and four of the orifices are circularly shaped. One of the rectangular orifices aligns with the mixing chamber and maximize's slurry entering the mixing area. Six of the seven additional apertures are for air input to the head and reservoir (sometimes referred to herein as the bottle, jar or container). One aperture is not used in that it abuts against the elongate passageway carrying water to and through the spray applicator. The invention includes a movable or rotatable disc with four (4) selectable outlet flow orifices (one rectangularly shaped and one circularly shaped) one of which is used as an outlet orifice and with the remaining orifices for air inflow to the head and then to the reservoir (i.e., aspiration of the head and reservoir). One of the orifices, however, will be substantially blocked at all times as it resides above the wall of the elongate flow passageway. There are four additional circularly shaped orifices or apertures which are used for aspiration of air. The stationary and fixed discs of the invention along with other features disclosed herein enable interchangeability between soluble fertilizer and insoluble grass seed. Another aspect of the invention includes a bottle neck ring which prohibits threading of the extension of the bottle too deeply into the sprayer head.

An apparatus for spraying lawn products adapted for use with a fluid supply source and a reservoir holding said lawn products includes a housing defining a mixing chamber therein. Soluble and insoluble products may be used in the reservoir. Further, detergent may be used in the reservoir. The apparatus is substantially made of plastic. The reservoir is coupled to the housing. A fluid supply source communicates a supply of a first fluid from the fluid supply source into the housing through an elongate passageway. A first passageway (fill passageway) communicates a first portion of the first fluid from the fluid supply source into the reservoir as a mixing fluid flow. A second passageway communicates the remaining portion of the first fluid from the fluid supply source into the mixing chamber through the direct passage. The mixing chamber empties through the outlet channel.

The housing includes a substantially cylindrically shaped cap portion having discontinuous internal threads forming flats therein, a lip portion, and an open end portion. The reservoir includes a generally cylindrically shaped neck portion having a partial exterior shoulder, external threads thereon, and an end portion.

The external threads of the generally cylindrically shaped neck portion of the reservoir interengage the discontinuous internal threads having flats therein of the substantially cylindrically shaped cap portion. The partial exterior shoulder of the generally cylindrically shaped neck portion of the reservoir interengages the open end portion of the substantially cylindrically shaped cap portion such that the end portion of the neck portion of the reservoir does not engage the lip portion of the substantially shaped cap portion enabling aspiration of the reservoir and the housing past the partial shoulder, the threads of the housing and reservoir and the flats of the housing.

An apparatus for spraying lawn products adapted for use with a fluid supply source and a reservoir holding the lawn products includes a housing defining a mixing chamber therein. The reservoir is coupled to the housing. The fluid supply source communicates a supply of a first fluid from the fluid supply source into the housing through an elongate passageway. A first passageway communicates a first portion of the first fluid from the fluid supply source into the reservoir as a mixing fluid flow. A second passageway communicates the remaining portion of the first fluid from the fluid supply source into the mixing chamber. The housing includes a substantially cylindrically shaped cap portion having discontinuous internal threads forming flats therein, a lip portion, and an open end portion. The reservoir includes a generally cylindrically shaped neck portion having a partial exterior shoulder, external threads thereon, and an end portion.

The internal threads of the generally cylindrically shaped neck portion of the reservoir interengage the discontinuous internal threads having flats therein of the substantially cylindrically shaped cap portion. A fixed disc is mounted to the cylindrically shaped cap portion of the housing and comprises a plurality of rectangularly shaped apertures. The fixed disc is in loose engagement with the lip of the cap portion of the housing such that air may flow between the fixed disc and the lip into the head portion. One of the rectangularly shaped apertures communicates with the mixing chamber. The fixed disc further includes four circularly shaped apertures which communicate with a head portion of the housing. A rotatably adjustable disc is in loose engagement with the fixed disc. The rotatably adjustable disc includes a rectangularly shaped-mixing flow aperture, a square shaped mixing flow aperture, an oval shaped mixing flow aperture and a circularly shaped mixing flow aperture any one of which may be selectively aligned with the one of the rectangularly shaped apertures communicating with the mixing chamber. The remaining apertures not aligned with the mixing chamber are aligned with the rectangular apertures of the fixed disc such that two of the remaining apertures communicate with the head of the housing. The rotatably adjustable disc further includes four circularly shaped apertures which align with the four circularly shaped apertures of the fixed disc. The apertures aligning with the mixing chamber control flow therethrough and the apertures aligned with each other aspirate the head of the housing and the reservoir. The partial exterior shoulder of the generally cylindrically shaped neck portion of the reservoir interengages the open end portion of the substantially cylindrically shaped cap portion such that the end portion of the neck portion of the reservoir does not engage the fixed and rotatable discs or the lip portion of the substantially shaped cap portion enabling aspiration of the reservoir and the housing past the partial shoulder, the threads of the housing and reservoir, the fixed and rotatable discs, and the flats of the housing.

A bottle and spray applicator is disclosed and claimed. The spray applicator includes a housing having a head and a passageway through the housing. The bottle includes a stop. The housing is threadedly interconnected with the bottle and interengages the stop on the bottle such that air may flow past the stop and the threaded interconnection and into the head of the housing and the bottle. The fixed disc includes four rectangularly shaped orifices located 90° apart. Any one of the four rectangularly shaped orifices of the fixed disc may be positioned adjacent to and aligned with the passageway.

Two of the four rectangularly shaped orifices are in communication with the head of the housing. The fixed disc also includes a plurality of circularly shaped orifices in communication with the head of the housing. A selectively rotatable disc resides adjacent the stationary disc. The rotatable disc typically is selectively rotated in 90° increments so as to adjust the flow apertures with respect to the fixed disc. The rotatable disc includes a plurality of flow control orifices, any one of which may be selectively aligned with the selected one of the four rectangularly shaped orifices of the fixed disc adjacent the passageway so as to control flow through the passageway.

Two of the flow control orifices of the rotatable disc are aligned with two of the rectangularly shaped discs for communication of air to and from the head. The rotatable disc further includes a plurality of circularly shaped apertures in alignment with the circularly shaped apertures of the fixed disc for communication of air to and from the head of the cap portion of the housing.

A process for aspirating a bottle and spray applicator is claimed and disclosed wherein the bottle (reservoir or container) includes a neck portion having exterior threads thereon, an end portion and a partial shoulder thereon. The spray applicator includes a housing which in turn includes a cap portion. The cap portion includes interior threads having flats therein, a passageway, a head portion, an end portion, and a lip. The cap portion further includes a fixed disc having a plurality of flow apertures and aspirating apertures. Further, the cap portion includes a rotatable disc having a plurality of flow apertures and aspirating apertures. The steps of the process include: inserting the fixed disc into engagement with the cap portion; aligning one of the flow apertures of the fixed disc with the passageway; inserting the rotatable disc into engagement with the fixed disc; rotatably selecting from one of a rectangular, square, oval or circular flow aperture of the rotatable disc and aligning it with the one of the flow apertures aligned with the passageway of the fixed disc, and, aligning the remaining flow and aspirating apertures with each other; interengaging the exterior threads of the neck portion with the interior threads of the cap portion; interengaging the end portion of the cap with the partial shoulder of the neck portion of the bottle; and, flowing air past the partial shoulder of the bottle, the threads and flats, and into the reservoir and the head portion. Alternatively, the flats in the threads of the cap portion of the housing extend past the lip so as to provide an airflow path above and below the fixed disc.

It is an object of the present invention to provide fixed and rotatable discs which permit aspiration of air between the reservoir and the head.

It is an object of the present invention to provide a partial shoulder or stop on the exterior of the reservoir which interengages the cap portion of the housing thus preventing the reservoir from bottoming out on a lip of the cap portion or on the rotatable and fixed discs and thus allowing aspiration of air between the reservoir and the head.

It is an object of the present invention to provide fixed and rotatable discs which include apertures therethrough which align which each other forming passageways between the reservoir and the head of the cap portion of the housing.

It is an object of the present invention to provide flats on the threaded interior cap portion of the housing which communicates air along the flats to an annular space formed between an end portion of a neck of the reservoir and the rotatable and fixed disc and then to the reservoir and head portion of the housing.

It is an object of the present invention to provide flats on the threaded interior cap portion of the housing which communicates air along the flats past the rotatable and fixed discs and then to exchange the air between the rotatable and fixed discs.

It is an object of the present invention to provide a process for aspirating a reservoir in combination with a spray applicator.

It is an object of the present invention to provide aspiration means to improve venturi performance.

It is an object of the present invention to protect against the defeat of the venturi through proper aspiration of the device.

It is an object of the present invention to provide air to the head portion and then into the container (reservoir).

It is an object of the present invention to provide indicia on the reservoir and the cap portion of the housing to prevent over-tightening of the cap to the housing.

These and other objects of the invention will be best understood when reference is made to the BRIEF DESCRIPTION OF THE DRAWINGS and the DESCRIPTION OF THE INVENTION which follow hereinbelow.

DESCRIPTION OF THE INVENTION

FIGS. 1-8 have been described in the related art Gavin '206 patent and are quoted hereinabove in the BACKGROUND OF THE INVENTION section of this patent application. FIGS. 1-8 and the description from the Gavin '206 patent have been substantially copied hereinabove and are incorporated by reference herein and may be relied upon as part of the disclosure hereof in combination with some or all of the novel features of the instant invention as described and depicted herein.

Figure 1:
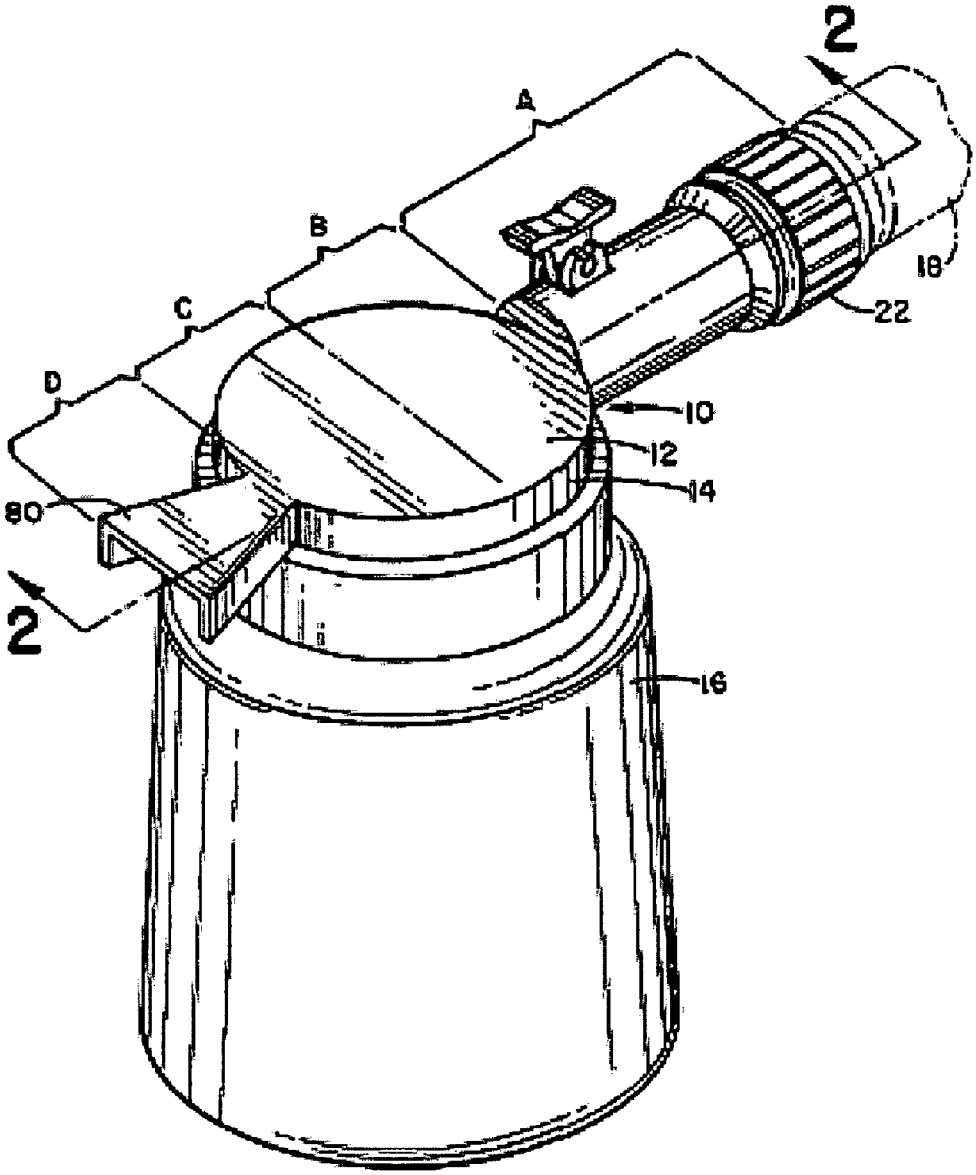
FIG.1 (PRIOR ART)
FIG. 1 is a perspective view of the prior art spray nozzle shown attached on one end to a fluid supply hose and at another end to a canister.
Figure 2:
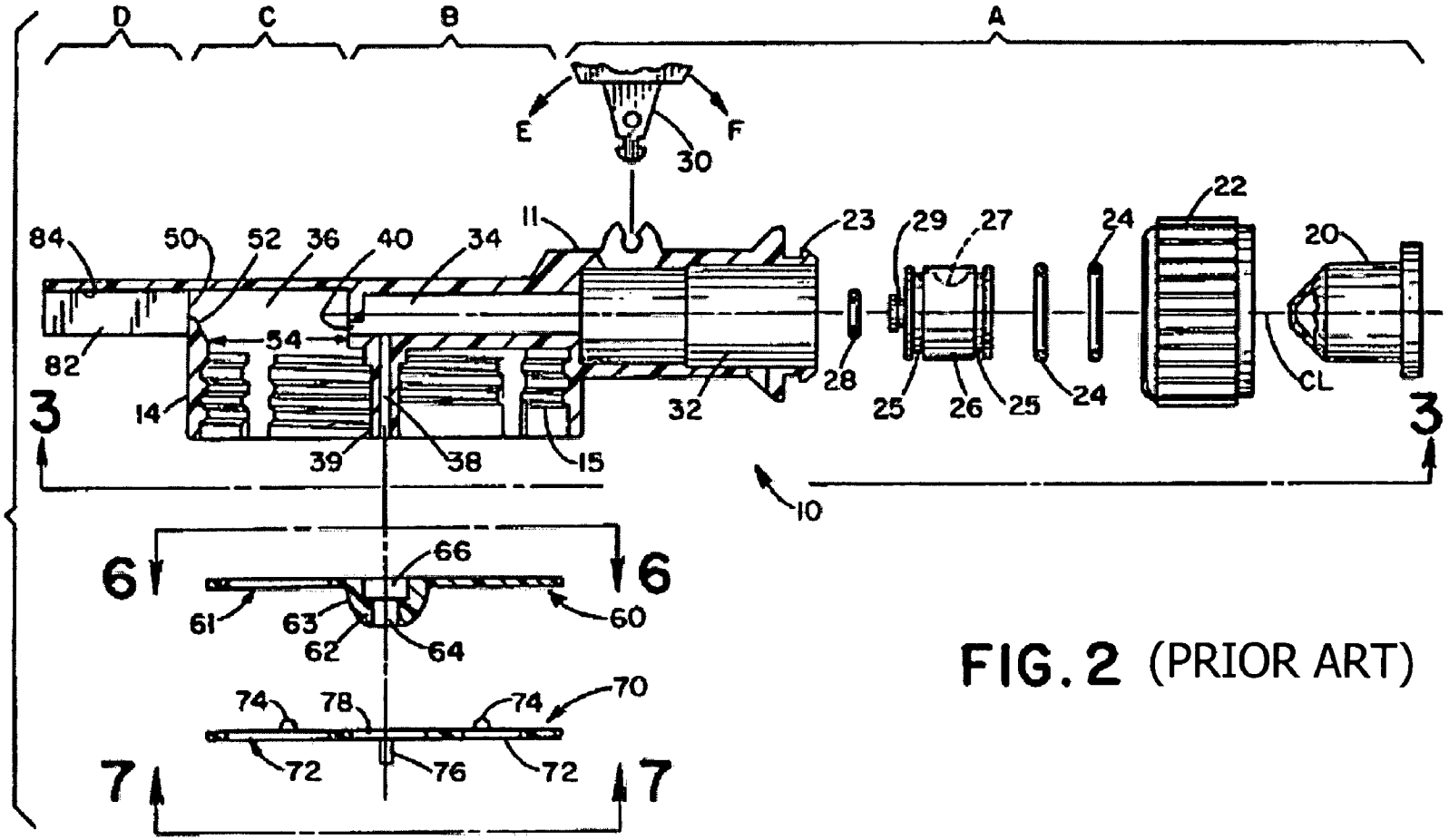
FIG. 2 (PRIOR ART)
FIG. 2 is an exploded and enlarged sectional view taken along the line 2-2 of prior art FIG. 1.
Figure 3:
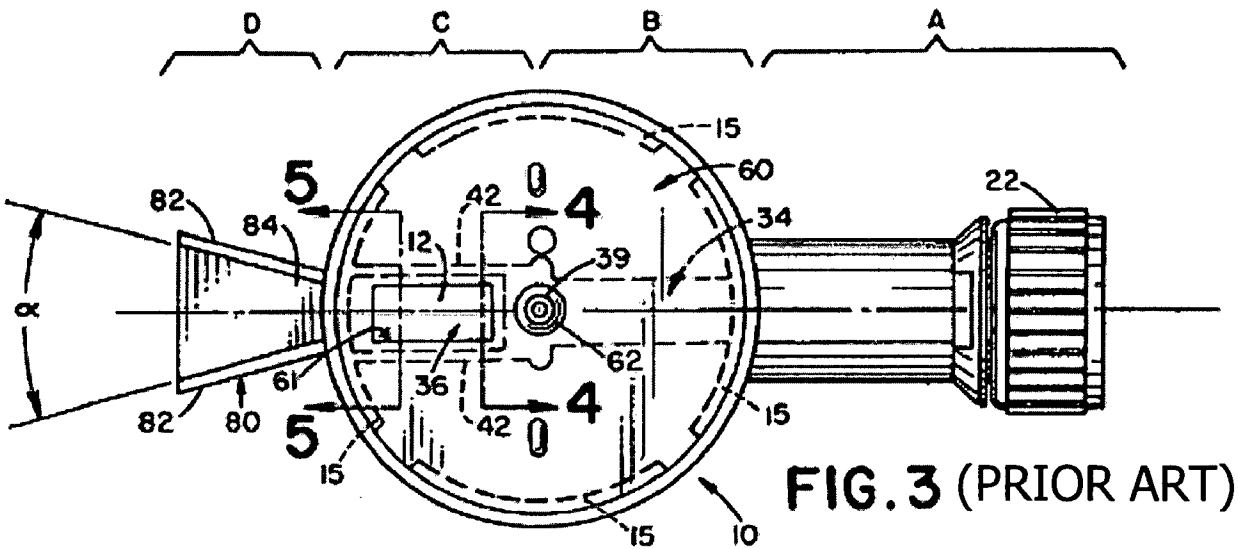
FIG. 3 (PRIOR ART)
FIG. 3 is an enlarged sectional view taken on the line 3-3 of prior art FIG. 2.
Figure 4:
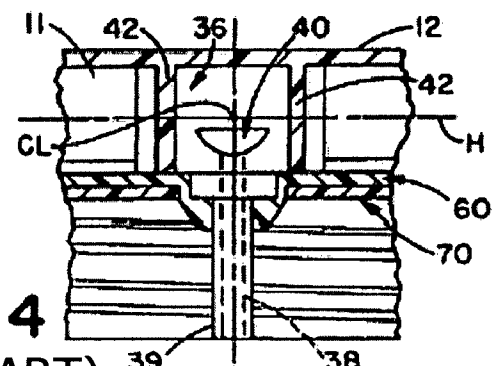
FIG. 4 (PRIOR ART)
FIG. 4 is an enlarged sectional view taken on the line 4-4 of prior art FIG. 3.
Figure 5:
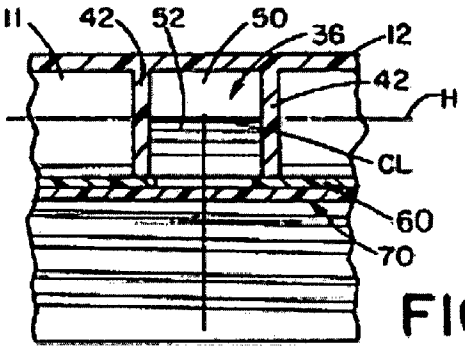
FIG. 5 (PRIOR ART)
FIG. 5 is an enlarged sectional view taken on the line 5-5 of prior art FIG. 3.
Figure 6:
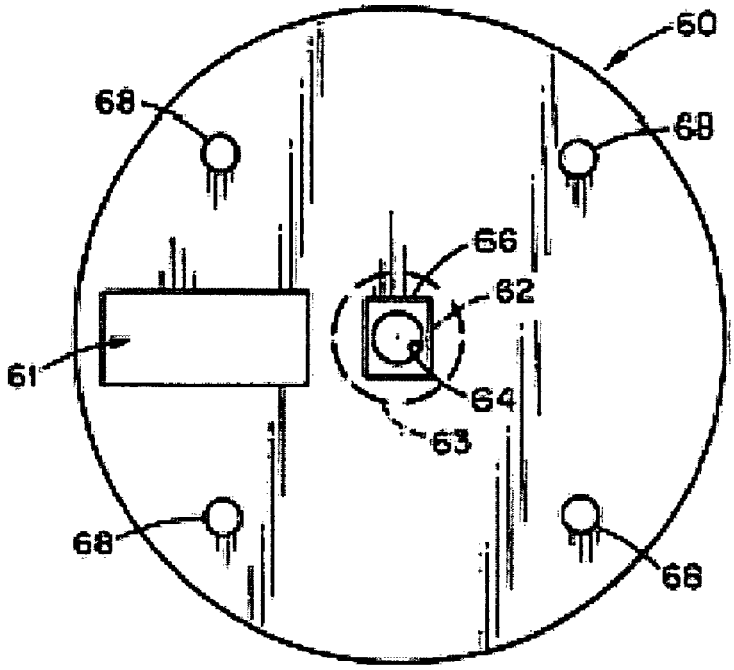
FIG. 6 (PRIOR ART)
FIG. 6 is an enlarged sectional view taken on the line 6-6 of prior art FIG. 2.
Figure 7:
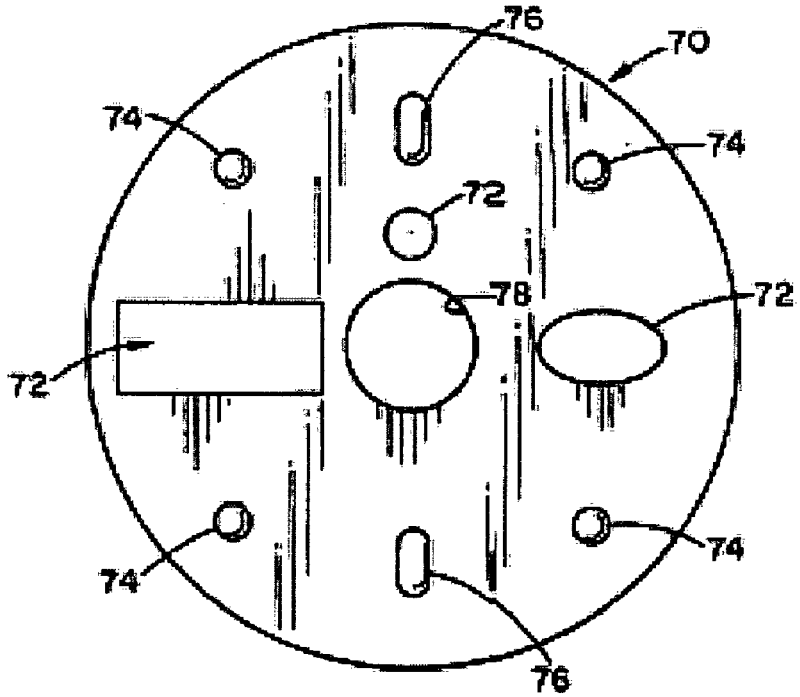
FIG. 7 (PRIOR ART)
FIG. 7 is an enlarged sectional view taken on the line 7-7 of prior art FIG. 2; and, FIG. 8 is a partial enlarged sectional view taken on the line 2-2 of prior art FIG. 1, illustrating the flow patterns arising due to the nature of the spray nozzle configuration.
Figure 8:
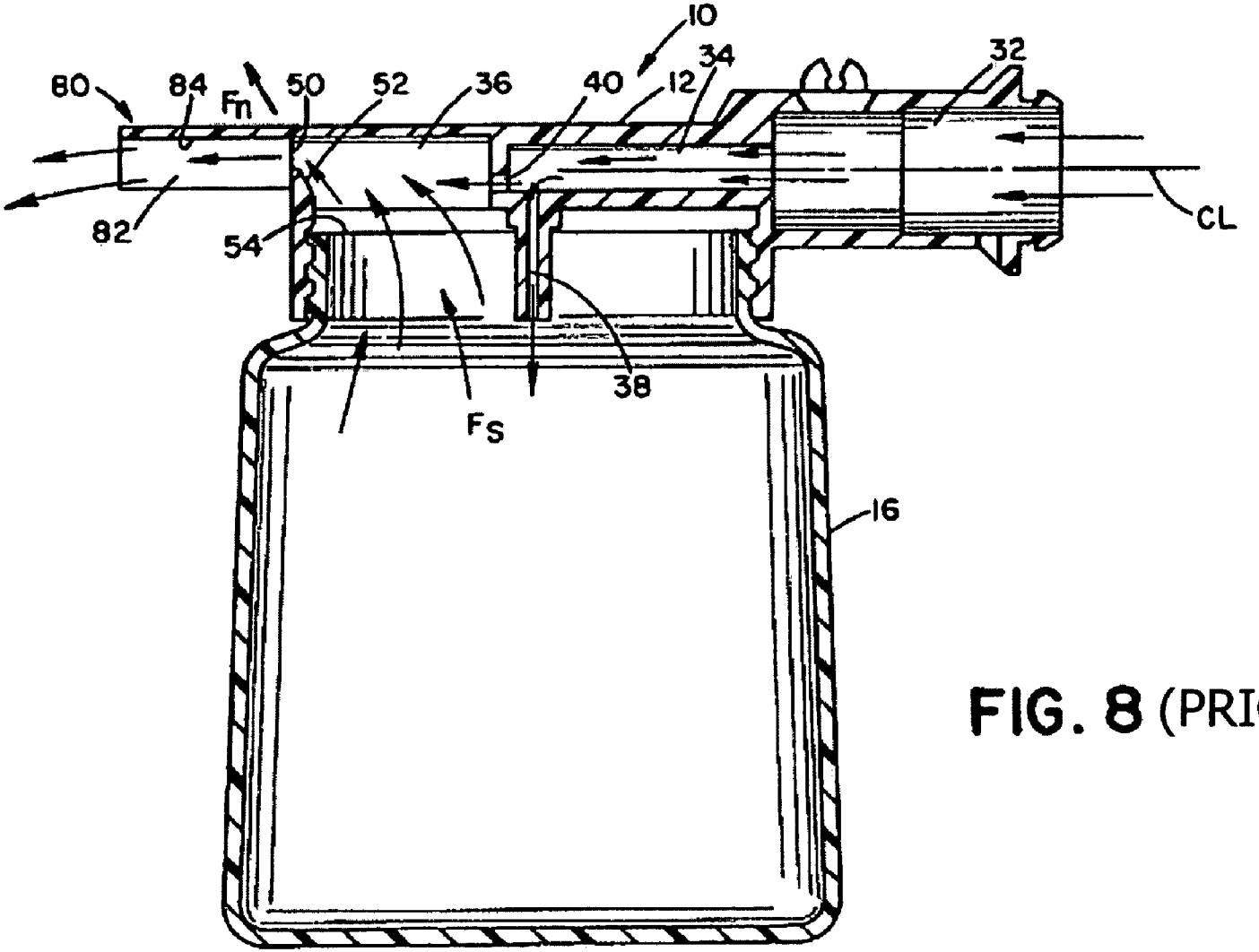
FIG. 8 (PRIOR ART)
Figure 9:
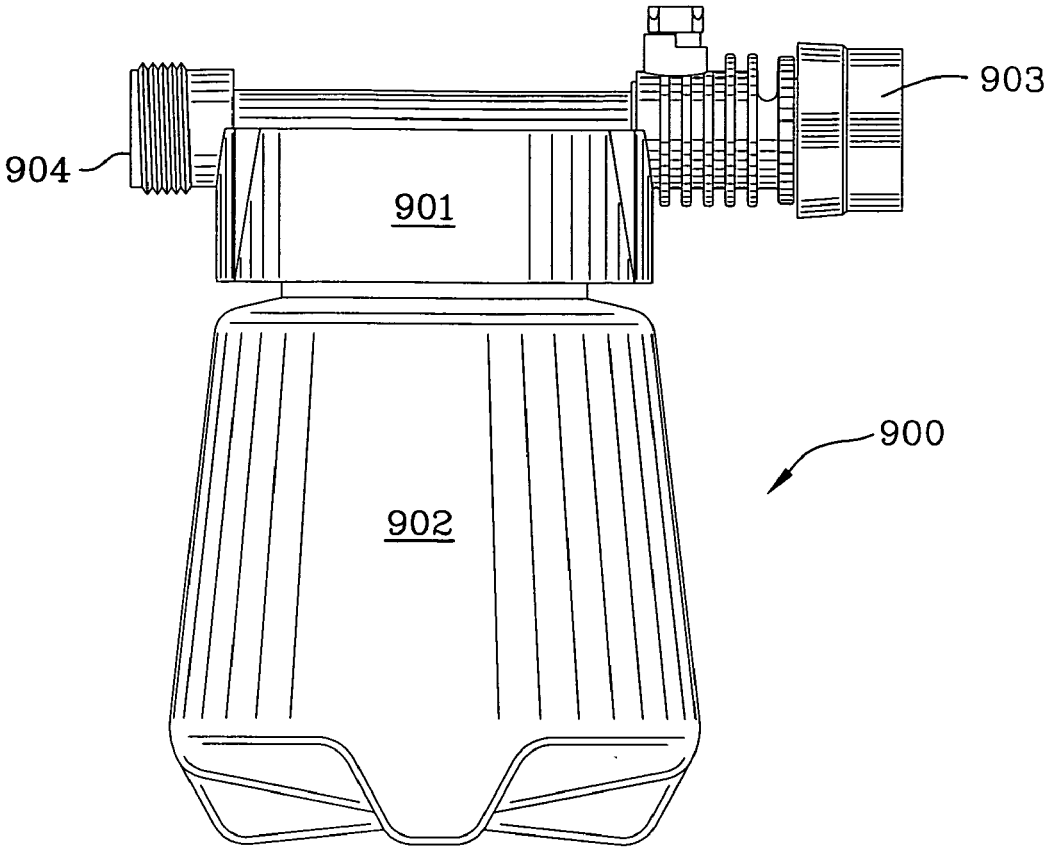
FIG. 9 (PRIOR ART)
FIG. 9 is a side view of a prior art Miracle Gro® spray applicator.
Figure 10:
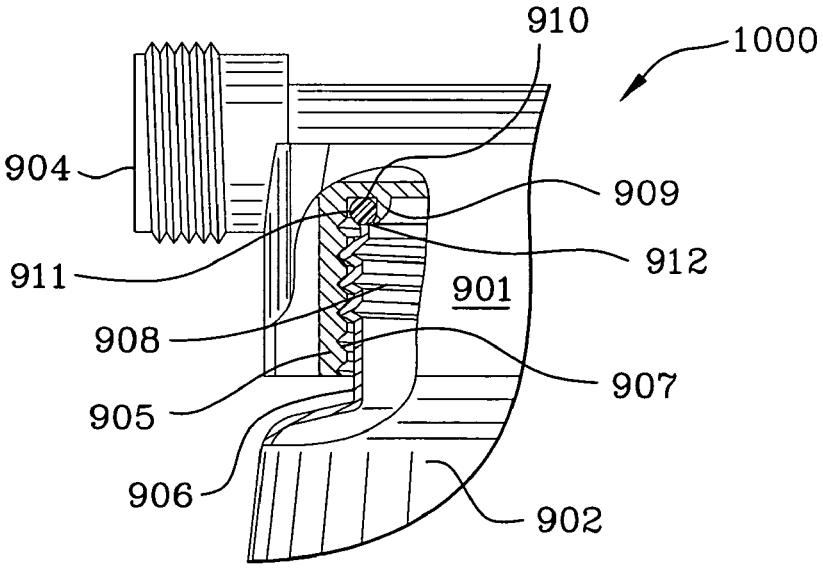
FIG. 10 (PRIOR ART)
FIG. 10 is a partial cut-away view of the prior art Miracle Gro® spray applicator illustrated in FIG. 9.
Figure 11:
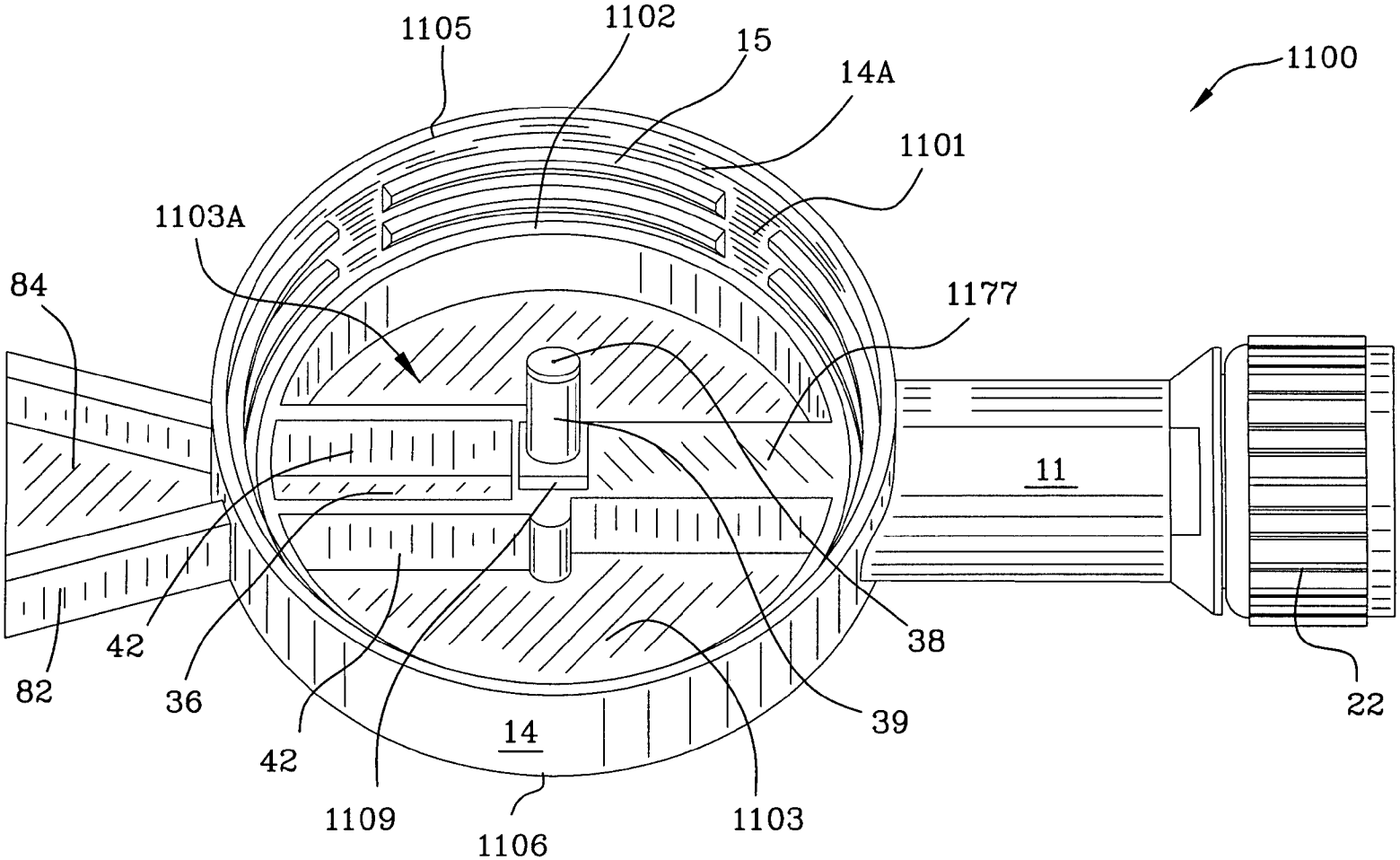
FIG. 11 (PRIOR ART)
FIG. 11 is a view of a prior spray applicator as illustrated in FIG. 1.
Figure 11A:
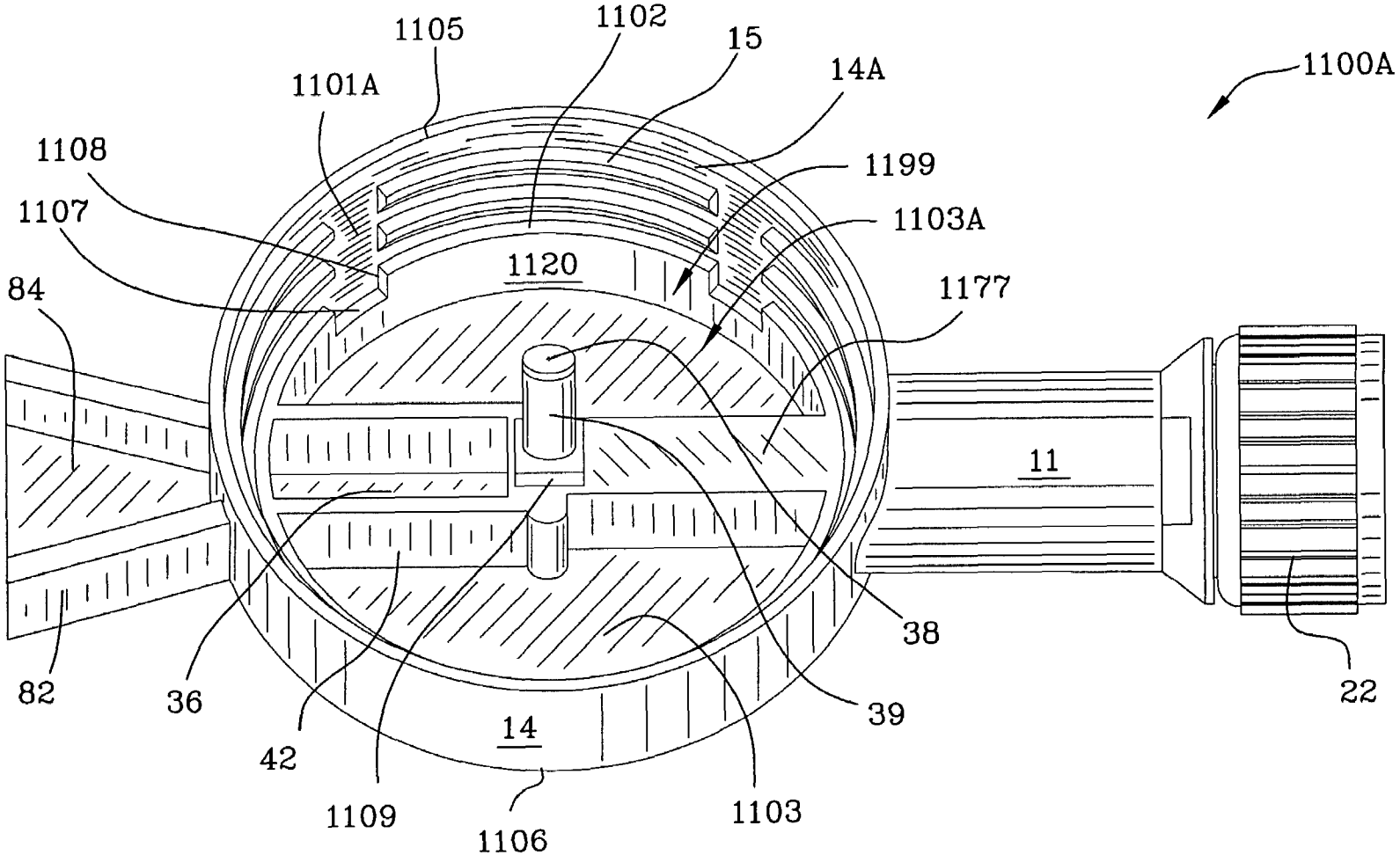
FIG. 11A is a view of a spray applicator having extended flats.

FIG. 11A is a view 1100A, more specifically, an interior view of the spray applicator with extended flats 1101A in the cap portion of the housing. The cap portion 1199 as seen in FIG. 11A and other drawing figures that it comprises the portion of the spray applicator which is threadedly interconnected with the bottle or reservoir as illustrated, for example, in FIG. 15 as well as the head portion 1103A.

Cap portion 1199 includes a circumferential wall defined by outer surface or rim 14 and inner surface 14A. Interior threads 15 are discontinuous. Lip 1102 is formed in the circumferential wall. Head portion 1103A is defined by the inner interior wall 1120 and the upper portion 1103 of the interior of the cap portion 1199 of the housing. Referring to FIG. 16B which is a cross-sectional view taken along the lines 16B-16B of FIG. 16, a fluid supply source enters from the hose connection on the right side of the drawing into the elongate passageway 34 through both direct passageway 40 and indirect passageway 38 (toward the reservoir). Fluid and solids in the reservoir are mixed and educted (i.e., sucked) into the mixing chamber created by the venturi formed by the principal flow through the direct passageway 40 and the outlet passageway 50.

Still referring to FIG. 11A, extended flats 1101A terminate in notch 1107 in the lip 1102. Walls 1108 form the notch 1107 in the lip 1102 and create a volume (space) which permits air to flow past the fixed 1220 and rotatable 1320 discs as will be explained in more detail hereinbelow.

Still referring to FIG. 11A, reference numeral 1103 represents the interior of the upper portion of the spray applicator which together with the inner interior wall 1120 of spray applicator forms the head portion 1103A. Head portion 1103A of the spray applicator is a volume in which air and/or a combination of air or fluid resides.

The cap portion 1199 of the spray applicator terminates in a bottom lip or end portion 1105. The outer top of the cap portion of the spray applicator is indicated by reference numeral 1106. Cap portion 1199 further includes male protrusion 1109 for interengagement with corresponding socket 66.

Figure 11B:
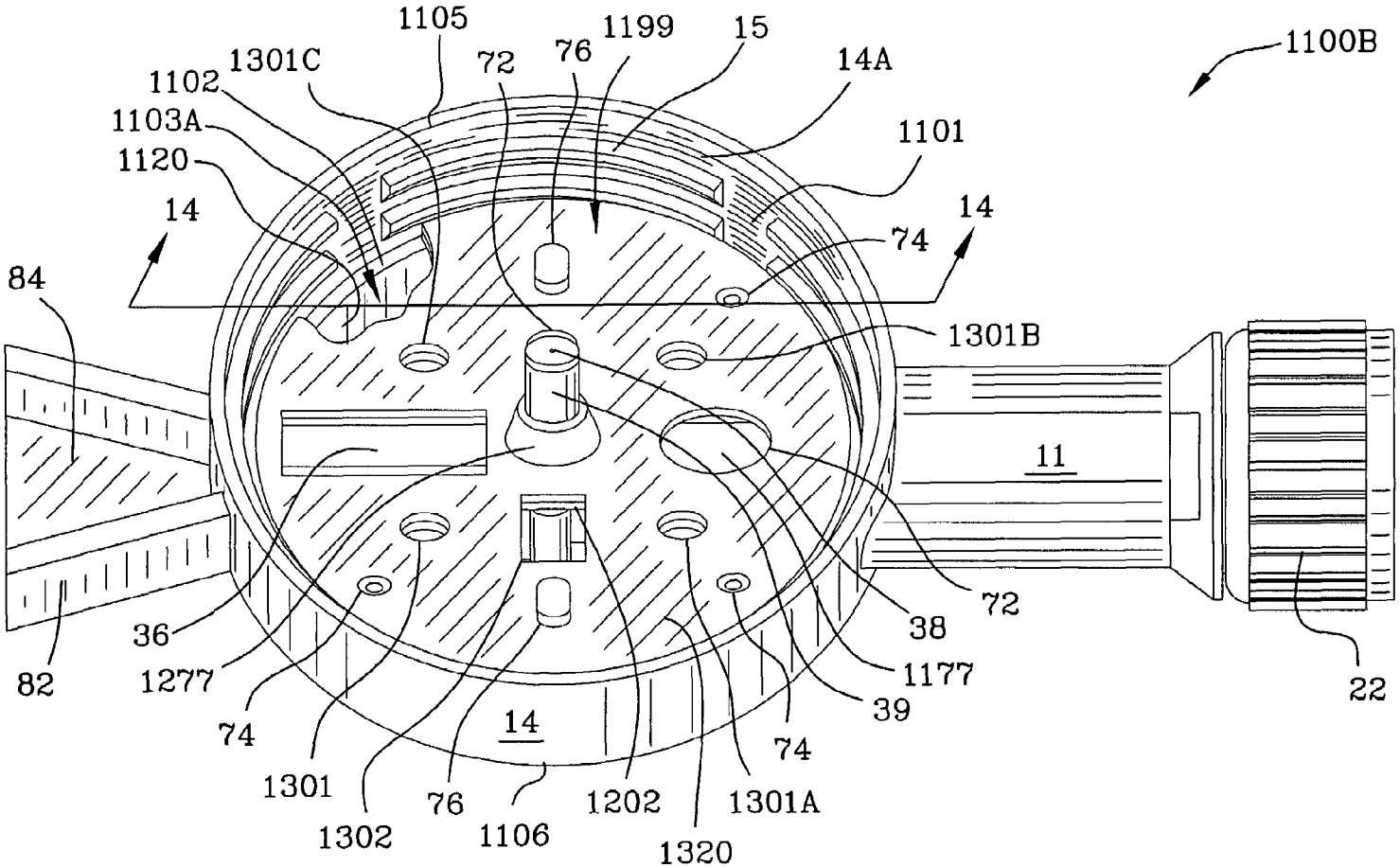
FIG. 11B is a view similar to FIG. 11 together with the fixed and adjustable discs of the invention.
Figure 12:
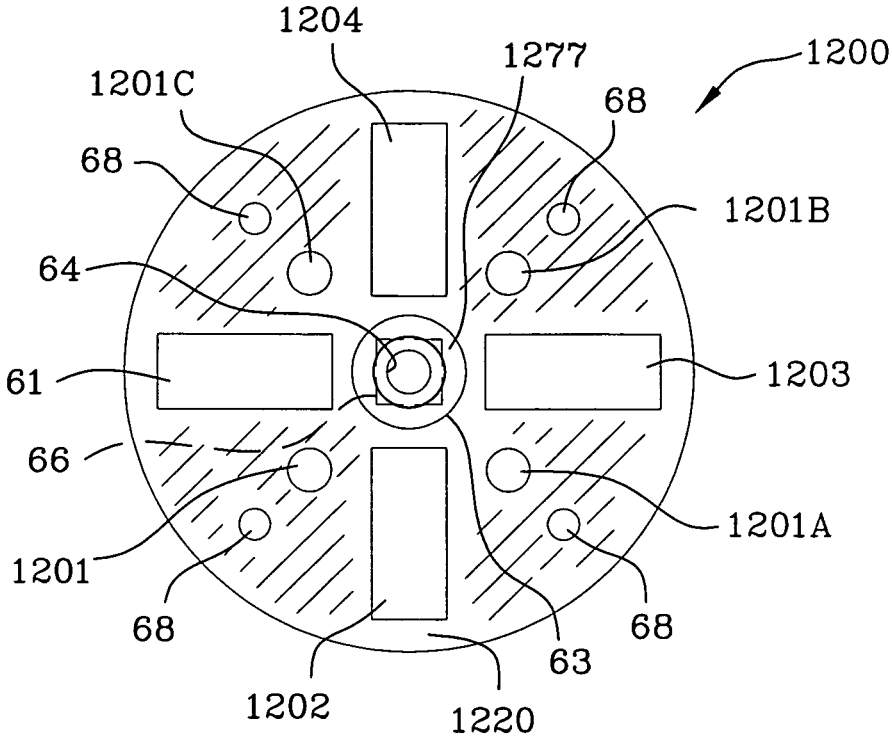
FIG. 12 is a view of the fixed disc of the invention.
Figure 13:
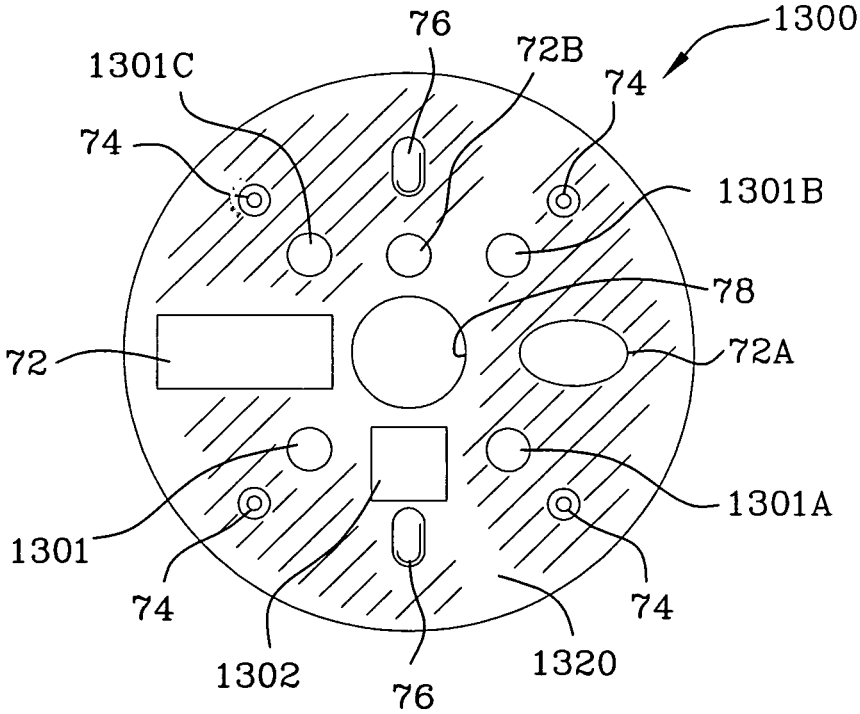
FIG. 13 is a view of the adjustable disc of the invention.

FIG. 11B is a view 1100B similar to FIG. 11 together with the fixed 1202 and adjustable discs 1302 of the invention placed in the cap portion 1199 of the housing. The diameter of discs 1220, 1230 is such that they are placed within the cap portion 1199 of the housing. As illustrated in FIG. 11B, fixed disc 1220 engages but does not seal against lip 1102. FIG. 12 is a view 1200 of the fixed disc 1220 and FIG. 13 is a view 1300 of the adjustable disc 1320. Fixed disc 1220 is mounted to the cylindrically shaped cap portion 1199 of the housing. Fixed disc 1220 includes a plurality of rectangularly shaped apertures 61, 1202, 1203, 1204 and is in loose engagement with the lip 1102 of the cap portion of the housing. One of the rectangularly shaped apertures 61, 1202, 1203, 1204 communicates with the mixing chamber 36. The fixed disc 1220 further includes four circularly shaped apertures 1201, 1201A, 1201B, 1201C which communicate with the head portion 1103A of the housing as viewed in FIGS. 11B, 11C, 14, 14A, 14B, and 14C.

The fixed and rotatable discs are approximately 0.40 inches thick. The cap portion 1199 is approximately 2.875 inches in diameter (outside diameter) and has a height of approximately 1.125 inches (outside dimensions).

Referring to FIGS. 11B and 13, rotatably adjustable disc 1320 is in loose engagement with the fixed disc 1220. Rotatably adjustable disc 1320 is adjusted by gripping tabs 76 and rotating them 90° clockwise or counterclockwise until dimples 74 engage recesses or positioning holes 68 of the fixed disc. The rotatably adjustable disc 1320 includes a rectangularly shaped-mixing flow aperture 72, a square shaped mixing flow aperture 1302, an oval shaped mixing flow aperture 72A, and a circularly shaped mixing flow aperture 72B, any one of which may be selectively aligned with the selected one of the rectangularly shaped apertures 61, 1202, 1203, 1204 communicating with the mixing chamber. The remaining three apertures (any three of 72, 1302, 72A and 72B) not aligned with the mixing chamber are aligned with a corresponding three of the rectangular apertures 61, 1202, 1203, 1204 of the fixed disc such that two sets of the remaining aligned apertures communicate with the head 1103A of the housing. The other set of apertures will be aligned with the enclosed elongate passageway 1177. Surface 78 of the rotatable disc 1320 is sized to frictionally engage the retainer ridge 63 of the fixed disc 1220.

Referring to FIGS. 11B, 11C, 16B, and 16C, it is apparent that oval shaped aperture 72A is not capable of communicating fluid even though aligned with one of the rectangularly shaped apertures, for instance, aperture 1203 of the fixed disc, as it is substantially blocked by the enclosed elongate passageway 1177.

Rotatably adjustable disc 1320 further includes four circularly shaped aspirating apertures 1301, 1301A, 1301B, 1301C which align with the four circularly shaped aspirating apertures 1201, 1201A, 1201B, 1201C of the fixed disc. One of the fixed disc flow apertures (61, 1202, 1203, 1204) aligns with one of the rotatable disc flow apertures (72, 1302, 72A and 72B) for direct flow control through the mixing chamber. The apertures aligned with each other and which are not aligned with the mixing chamber or elongate passageway 1177 aspirate head 1103A of the cap portion 1199 of the housing and the reservoir.

Figure 13A:
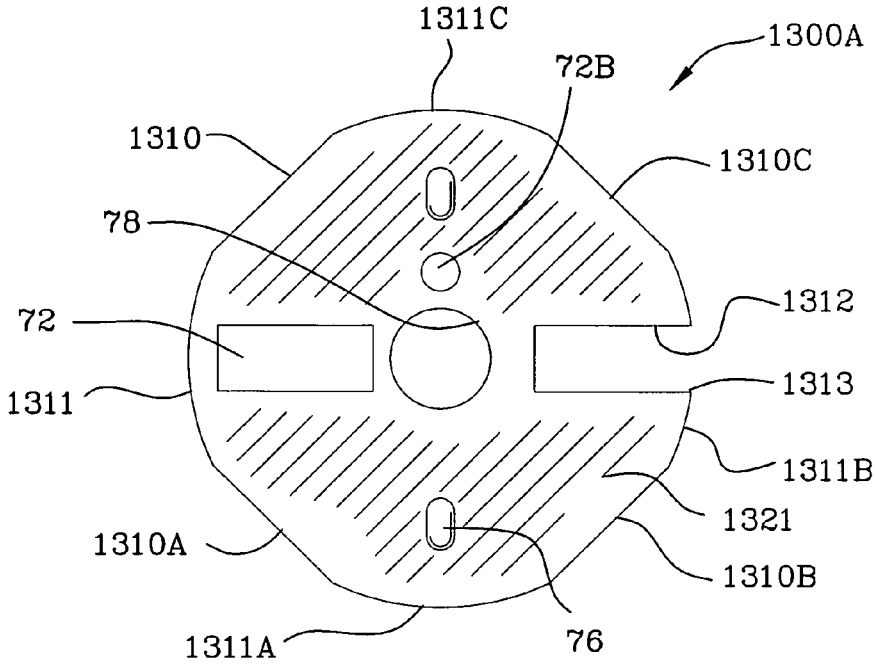
FIG. 13A is another example of the adjustable disc of the invention.

FIG. 13A is another example 1300A of the adjustable disc 1321 of the invention. First, second, third, and fourth cords 1310, 1310A, 1310B, 1310C of adjustable disc 1300A are viewed in FIG. 13A and provide additional flow area for aspirating air. First, second, third and fourth arcs 1311, 1311A, 1311B, 1311C of rotatable disc are viewed in FIG. 13A as well. Adjustable disc 1300A includes notch 1313 formed of walls 1312 of the notch in adjustable disc.

Figure 15:
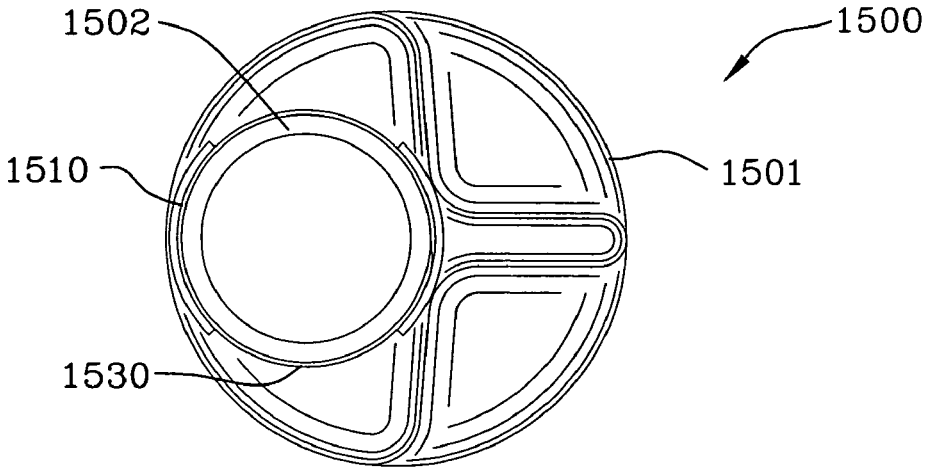
FIG. 15 is a top view of bottle of the invention.
Figure 15A:
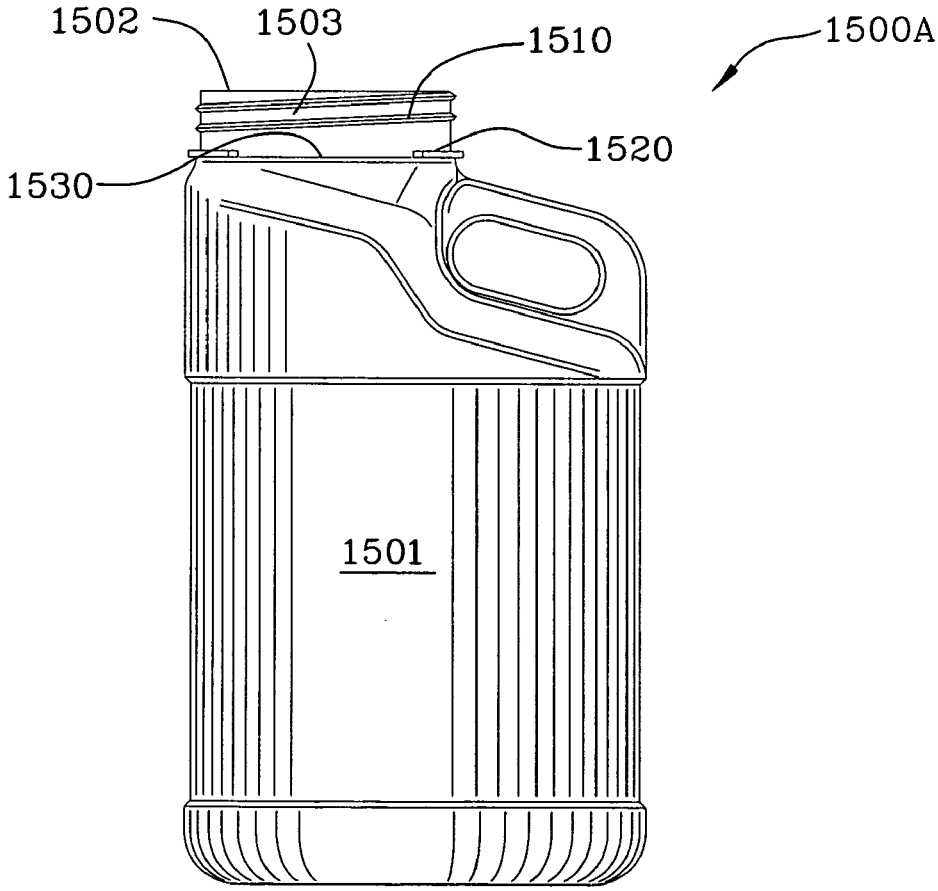
FIG. 15A is a side view of the bottle of FIG. 15.
Figure 15B:
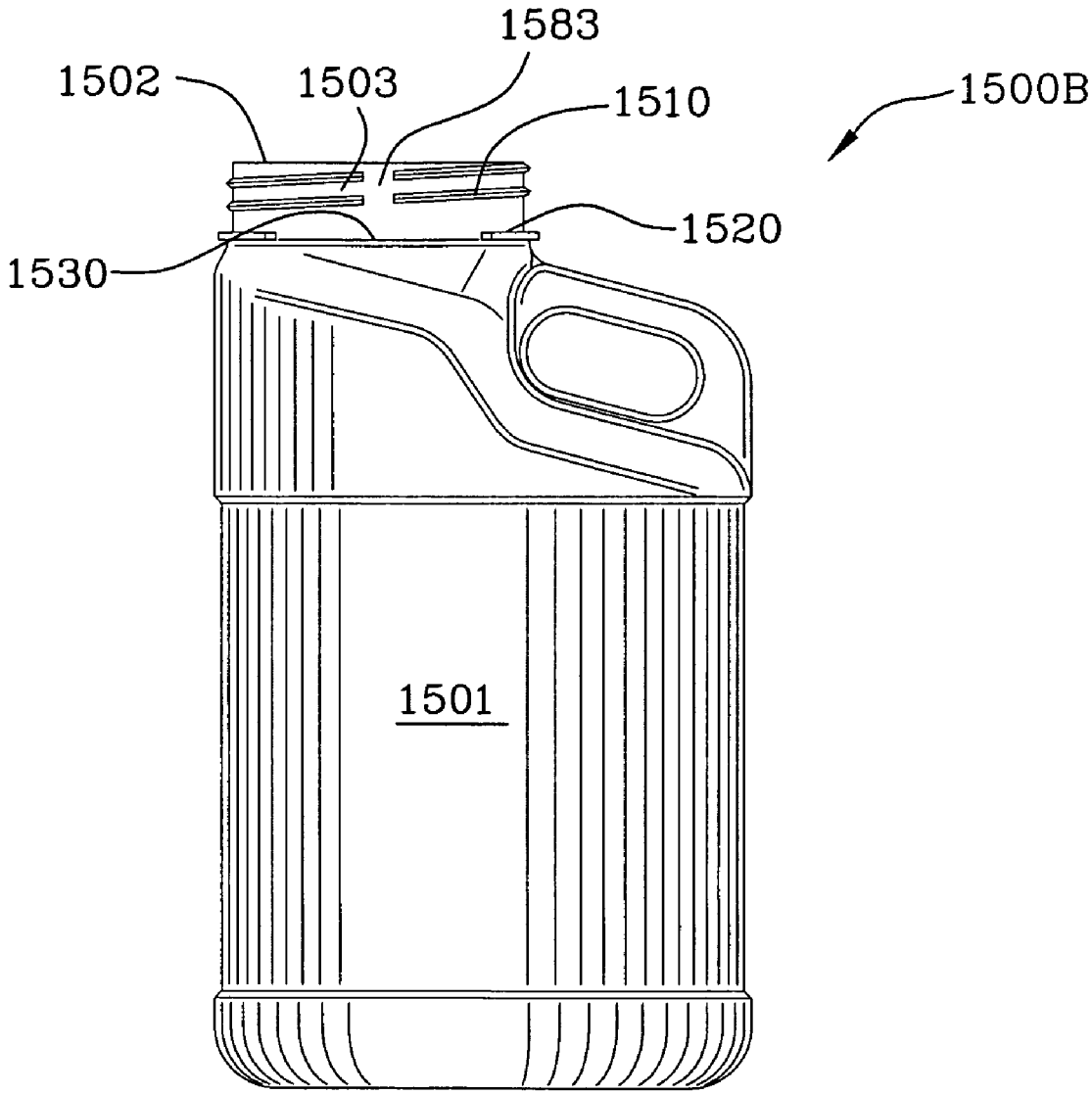
FIG. 15B is an illustration of a bottle having flats in the threads of the bottle which may be used in, for example, a cap portion of the housing which does not have flats in its threads.

FIG. 15 is a top view 1500 of bottle of the invention holding solubles and/or insolubles. FIG. 15A is a side view 1500A of the bottle of FIG. 15. Reference numeral 1501 indicates the wall of the bottle with the interior of the bottle designated by reference numeral 1501A. FIG. 15B is an illustration of a bottle having flats 1583 in the threads of the bottle which may be used in, for example, a cap portion of the housing which does not have flats in its threads.

The reservoir or bottle includes a top lip 1502 and a neck 1503. Spiral shaped exterior threads 1510 are illustrated on the neck 1503 of the bottle. A partial shoulder forming stop 1520 is illustrated with a large discontinuity in the shoulder represented by reference numeral 1530 indicated. Sometimes hereinafter the discontinuity in the threads may be indicated as a flat on the exterior of the bottle between the stops 1520.

The partial exterior shoulder 1520 of the generally cylindrically shaped neck portion of the reservoir interengages the end portion 1105 of the substantially cylindrically shaped cap portion 1199 such that the end or lip portion 1102 of the neck portion 1103 of the reservoir does not engage the fixed 1220 and rotatable 1320 discs or the lip portion 1102 of the substantially cylindrically shaped cap portion enabling aspiration of the reservoir and the head portion of the housing past the partial shoulder 1520, the threads 15, 1510 of the cap portion of the housing and reservoir, the fixed and rotatable discs, and the flats of the cap portion of the housing.

Figure 11C:
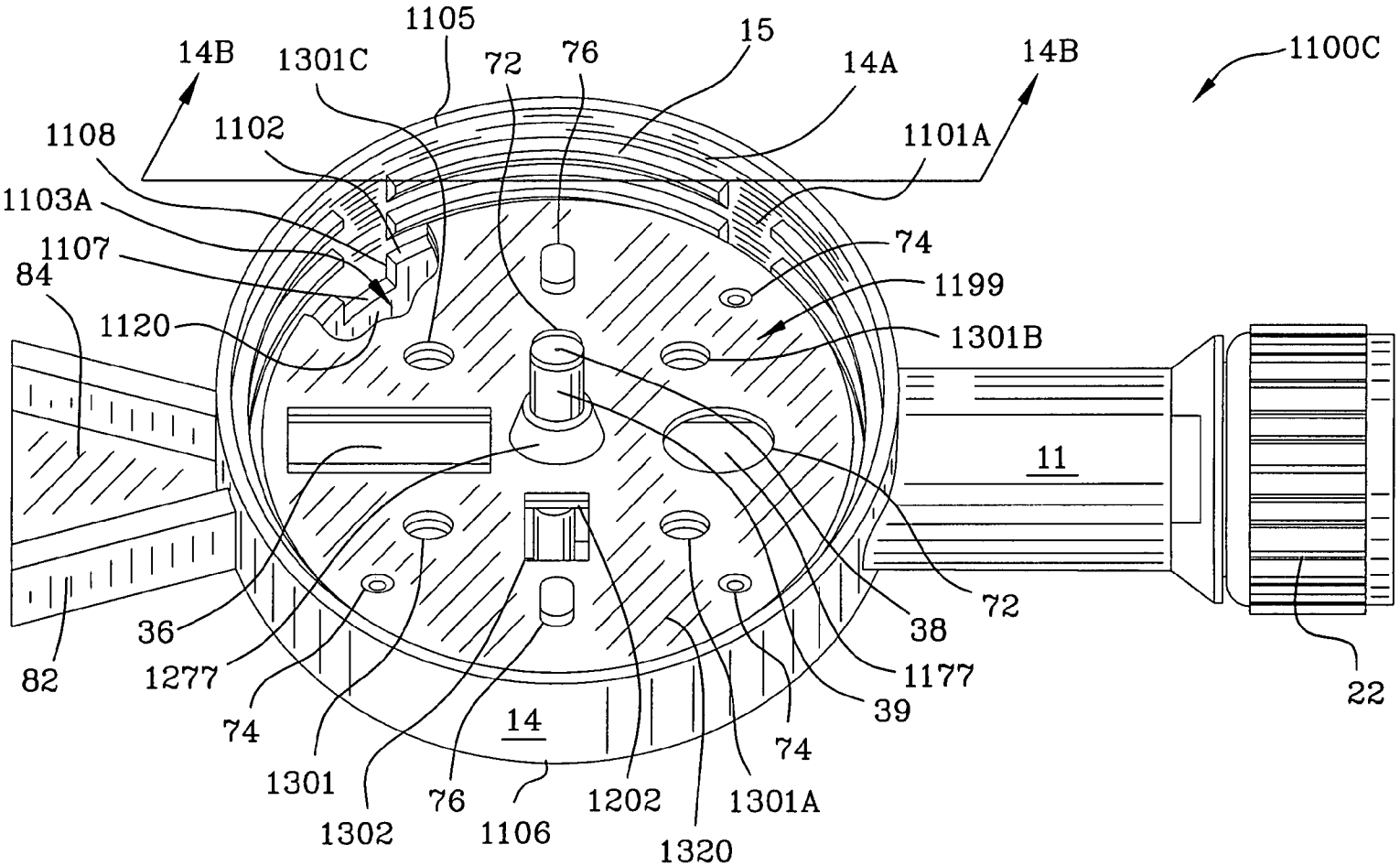
FIG. 11C is a view similar to FIG. 11A together with the fixed and adjustable discs of the invention.

FIG. 11C is an interior view 1100C of the cap portion 1199 of the spray applicator with extended flats 1101A similar to FIG. 11A together with the fixed 1220 and adjustable discs 1320 secured to the cap portion of the housing as described herein. FIG. 11C has a cutaway portion which exhibits the notch 1107 formed by walls 1108. Fixed 1220 and rotatable 1320 discs are illustrated. Fixed disc 1220 is in loose engagement with lip 1102 and rotatable disc 1320 is snugly fit over the fixed disc 1220. Since the discs 1220, 1320 do not seal against the lip 1102 air may flow between lip 1102 and the discs 1220, 1320. Additionally, the discs are made of thin plastic which enable air to flow by them as they are secured in the cap portion of the housing. Discs 1220, 1230 are mounted within the cap housing and are diametrically smaller than the thread diameter of the cap portion of the housing.

Fixed disc 1220 includes a crown or mushroomed portion 1277 over which aperture 78 of the rotatable disc 1320 fits to snugly fit the discs together, together with the dimples and recesses previously described. Disc 1220 includes a socket 66 for reception of the male protrusion 1109. Male protrusion may be square or rectangularly shaped. Other shapes of the protrusion and corresponding socket shapes are contemplated.

Figure 14:
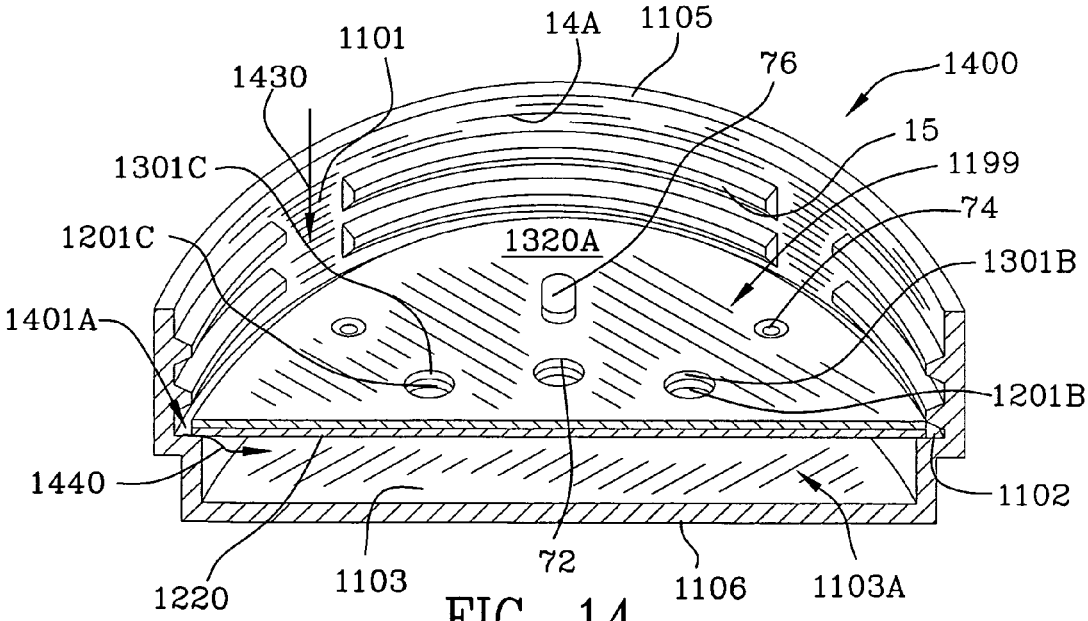
FIG. 14 is a perspective cross-sectional view of the fixed and adjustable discs mounted in the cap of the housing of the invention taken along the lines 14-14 of FIG. 11B.

FIG. 14 is a perspective cross-sectional view 1400 of the fixed 1220 and adjustable 1320 discs mounted in the cap of the housing of the invention taken along the lines 14-14 of FIG. 11B. In this example it will be noticed that airflow along the flats will occur which allows equal pressurization when the housing is mounted to the bottle through the threaded interconnection of the bottle and the cap portion of the housing. Air moves circumferentially along the passageway of the threads of the bottle as well. As is described elsewhere herein, air flows around the plates to the head portion 1103A as indicated by air flow arrows 1430, 1440. A gap 1401A exists between wall 14A of the cap portion 1199 and the discs 1220, 1320.

Figure 14A:
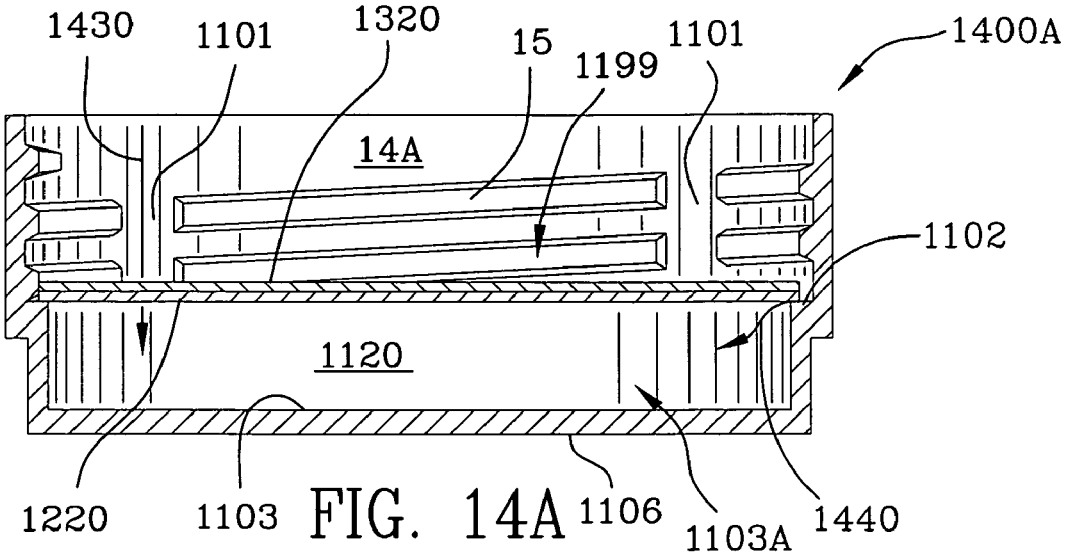
FIG. 14A is a cross-sectional view of the fixed and adjustable discs mounted in the cap of the housing of the invention taken along the lines 14-14 of FIG. 11B.

FIG. 14A is a cross-sectional view 1400A of the fixed 1220 and adjustable 1320 discs mounted in the cap portion of the housing of the invention taken along the lines 14-14 of FIG.

11B. Referring to FIG. 14A, air flow is indicated by arrow 1430 as extending past plates 1220 and 1320. Fixed disc 1220 is shown engaging lip 1102 as viewed in FIG. 14A. FIGS. 11-11C and 14-14C are shown inverted to reveal the interior of the cap portion and its components. Further, FIGS. 14-14C illustrate the generally cylindrically shaped cap portion of the housing not connected to a corresponding bottle. Flow arrow 1440 in FIG. 14A illustrates airflow under fixed disc 1220 into head portion 1103A formed by the interior 1103 of upper portion of the housing and the generally cylindrically shaped wall 1120. Although no airflow arrow is shown in FIG. 14A along the surface 1320A of the rotatable disc 1320, air will flow there as well. Air flow along flow arrow 1440 in FIGS. 14 and 14A is possible as the bottle (reservoir) not shown does not compressively engage the rotatable disc 1320. Therefore the discs 1220, 1320 do not seal against the lip 1102.

Figure 14B:
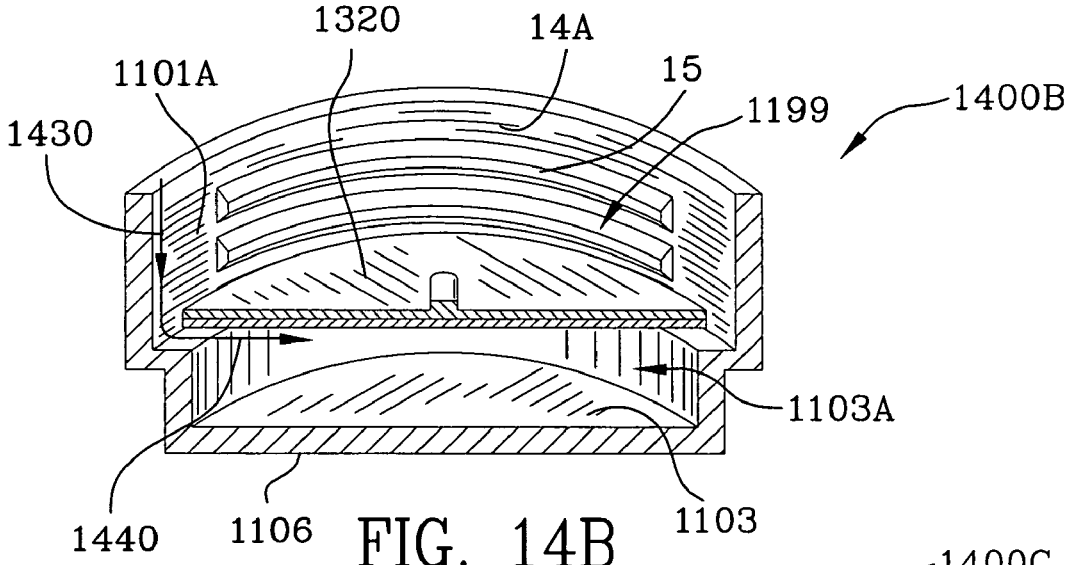
FIG. 14B is a perspective cross-sectional view of the fixed and adjustable discs mounted in the cap of the housing of the invention taken along the lines 14B-14B of FIG. 11C.
Figure 14C:
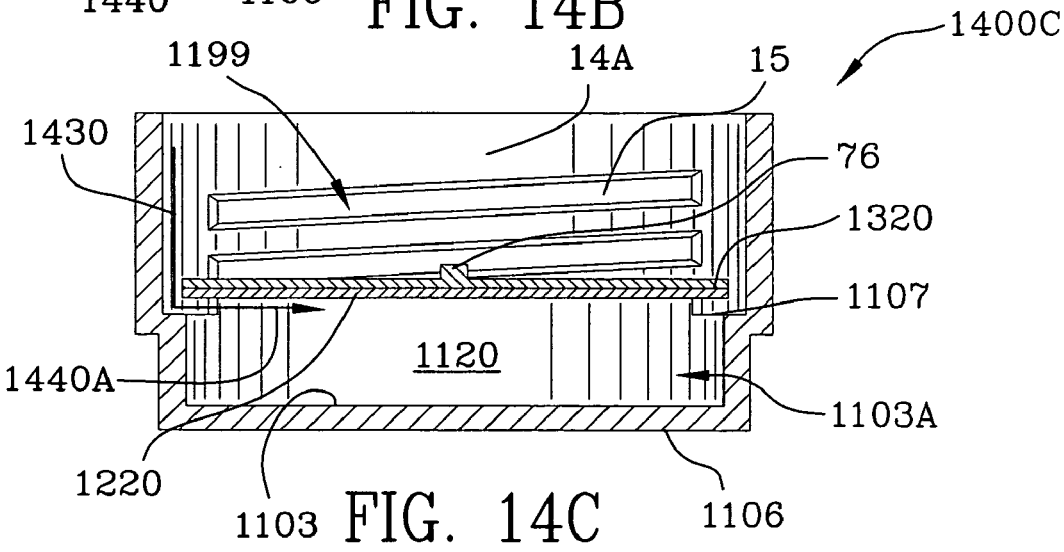
FIG. 14C is a cross-sectional view of the fixed and adjustable discs mounted in the cap of the housing of the invention taken along the lines 14B-14B of FIG. 11C.

FIG. 14B is a perspective cross-sectional view 1400B of the fixed 1220 and adjustable 1320 discs mounted in the cap of the housing of the invention taken along the lines 14B-14B of FIGS. 11A and 11C. FIGS. 11A and 11C illustrate the cap portion of the housing with extended flats 1101A and that cross-sectional view is taken along these flats. Again, air flows along the flats 1101A and along the spaces intermediate threads 15 and the mating threads of the bottle (not shown). FIG. 14C is a cross-sectional view 1400C of the fixed 1220 and adjustable 1320 discs mounted in the cap of the housing of the invention taken along the lines 14B-14B of FIGS. 11A and 11C. FIG. 14C shows the extended flats well and notch 1107 in the lip 1102 of the cap. In the example of the extended flats 1101A it can be seen that air flow is unimpeded to the head 1103A.

The spray applicator described herein and all of its constituent parts are primarily made of light weight plastics. The cap portion 1199 of the housing is plastic as is the bottle (reservoir). The plastic parts are preferably molded and are of light weight.

Figure 16:
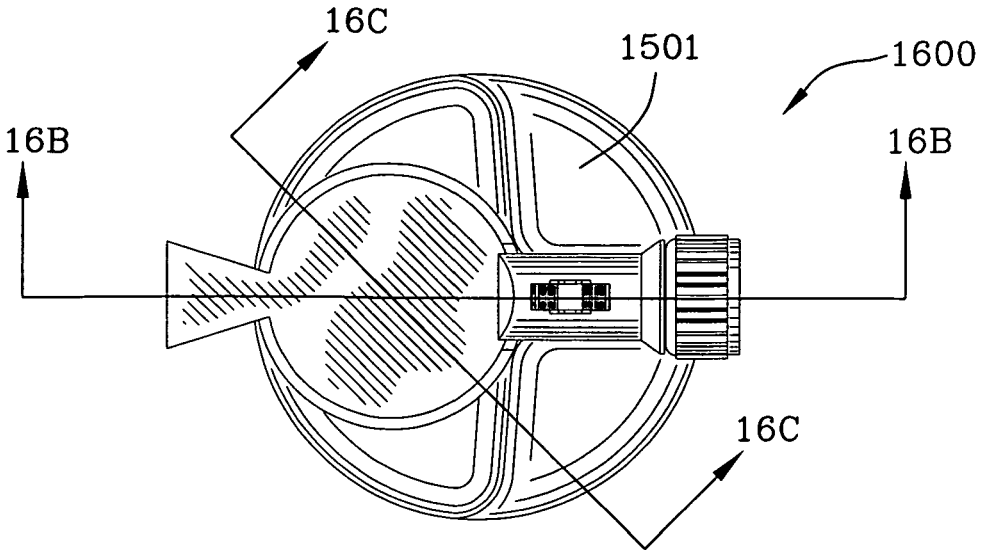
FIG. 16 is a top view of the bottle of the invention with the sprayer mounted thereon.
Figure 16A:
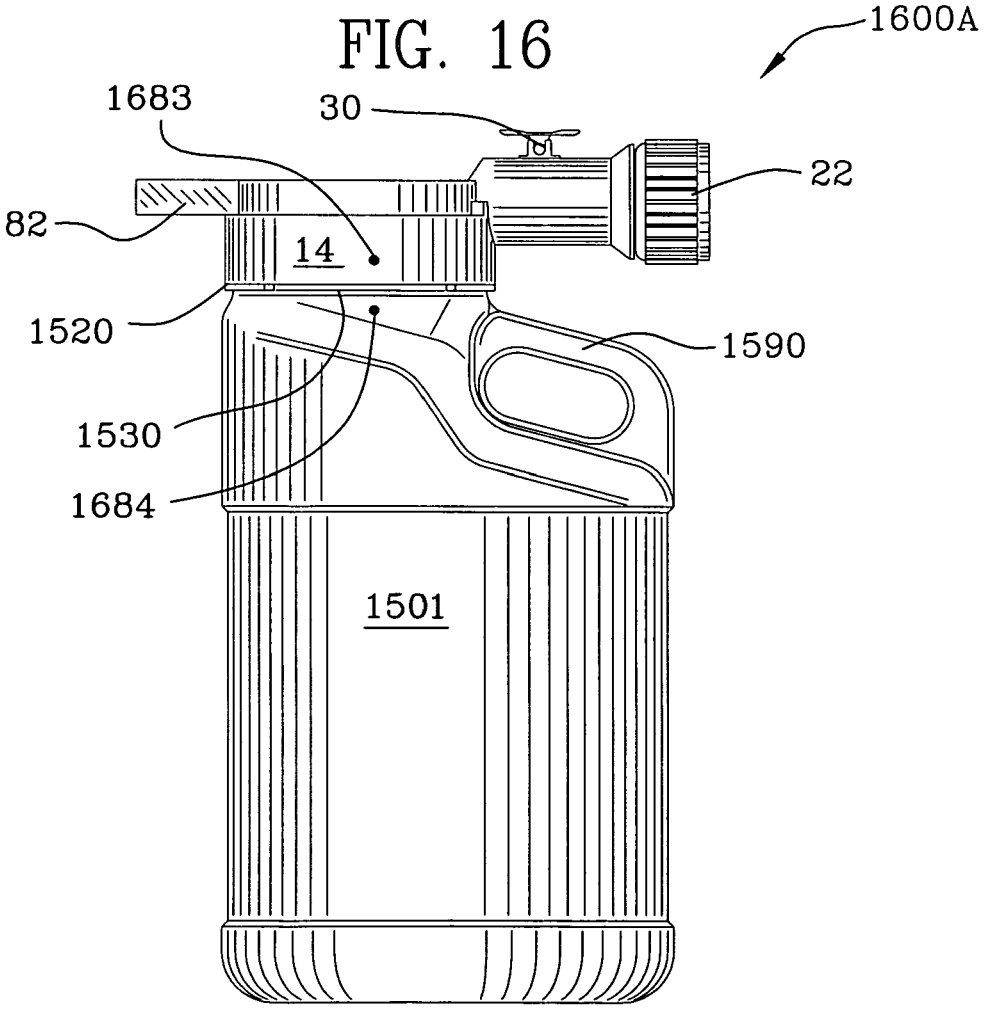
FIG. 16A is a side view of the bottle of the invention with the sprayer mounted thereon.
Figures 16B, 16C, 16D:
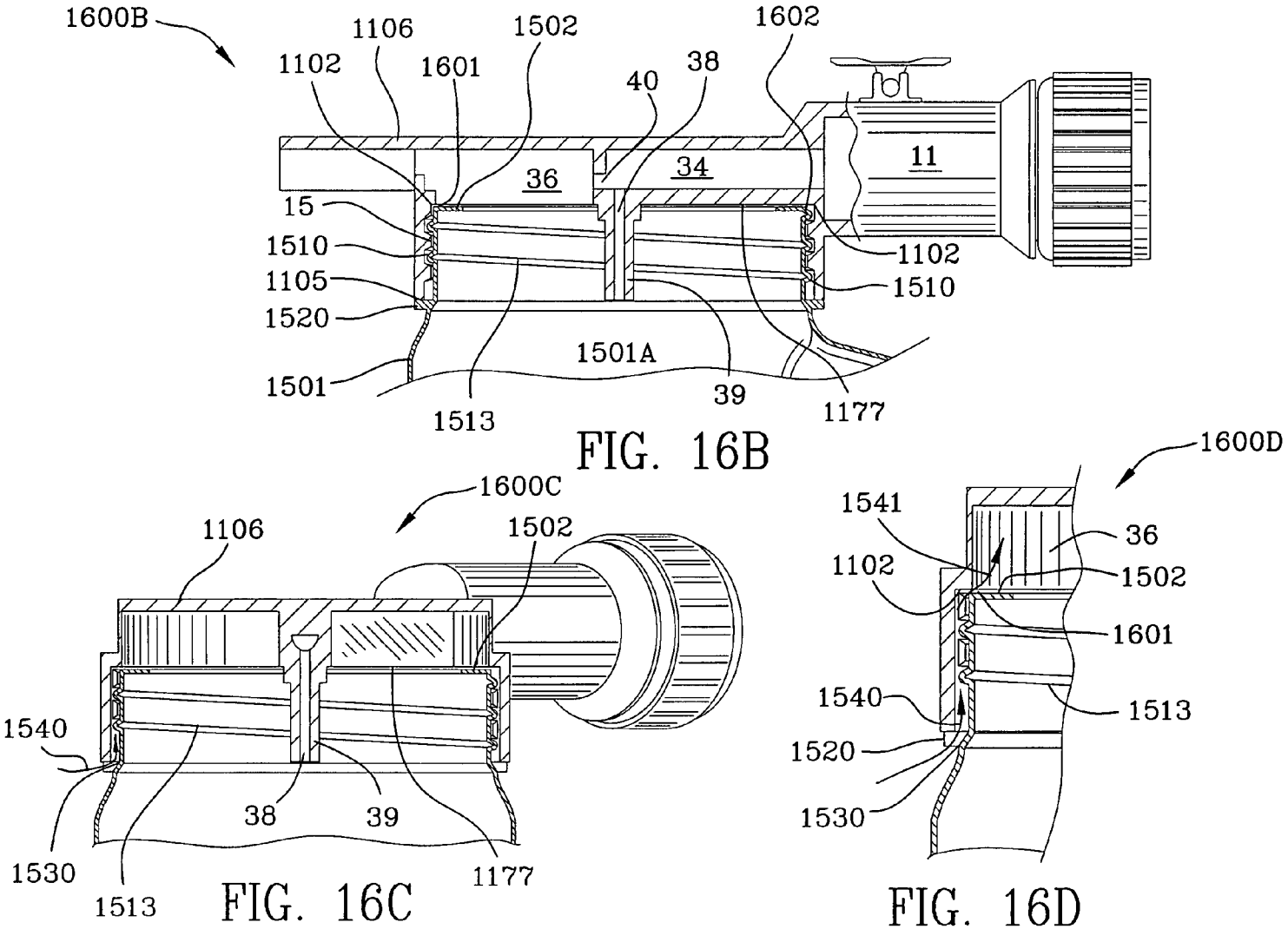
FIG. 16B is a cross-sectional view of the bottle taken along the lines 16B-16B of FIG. 16.
FIG. 16C is a cross-sectional view of the bottle taken along the lines 16C-16C of FIG. 16.
FIG. 16D is an enlargement of a portion of FIG. 16C.

FIG. 16 is a top view 1600 of the bottle 1501 and sprayer mounted thereon. FIG. 16A is a side view 1600A of the bottle of the invention with the sprayer mounted thereon illustrating the partial shoulder forming a stop 1520 and a flat (or discontinuity) 1530 extending between the stop enabling ingress of air to the head 1103A of the cap 1199 of the housing and to the reservoir to substantially equalize the pressure outside and inside the reservoir bottle. If no partial shoulder or other stop is utilized then indicia 1683 on the cap portion and indicia 1684 on the container portion may be employed to prevent over-tightening of the cap with respect to the bottle thus insuring that inwardly directed air flow is not prohibited. The indicia 1683, 1684 may be simply aligned to prevent over-tightening.

FIG. 16B is a cross-sectional view 1600B of the bottle taken along the lines 16B-16B of FIG. 16. It will be noticed that in FIG. 16B no discs 1220, 1230 are illustrated. Gaps 1601, 1602 are formed between the top lip of bottle 1502 (sometimes referred to herein as the end portion of the bottle) and lip 1102 so as to allow air passage therebetween. It will further be noticed that stop 1520 abuts the end portion 1105 preventing over-tightening of the bottle such that the top lip 1502 of the bottle does not engage lip 1102. Still referring to FIG. 16B, exterior threads 1510 of the bottle interengage threads 15 of the cap to securely interengage the bottle and the cap while still allowing air passage along the threads of the bottle and the flats (not shown in this view). The fluid supply source communicating a supply of first fluid from the fluid supply source into the housing through an elongate passageway is illustrated in FIG. 16B as well. A first passageway 38 for communicating a first portion of the first fluid from the fluid supply source into the reservoir 1501 as a mixing fluid flow is also illustrated in FIG. 16B. A second passageway communicating the remaining portion of the first fluid from the fluid supply source into the mixing chamber 36 is also shown as is the back-splash plate.

FIG. 16C is a cross-sectional view 1600C of the bottle taken along the lines 16C-16C of FIG. 16. FIG. 16D is an enlargement 1600D of a portion of FIG. 16C illustrating the airflow passageways 1540, 1541 and the gap 1601 between the lip 1502 of the bottle and lip of the cap portion. Interior recesses 1513 of the bottle's teeth are illustrated in FIGS. 16B-D. Also illustrated well in FIG. 16D is the flat 1530 between the partial shoulder 1520.

Figure 16E:
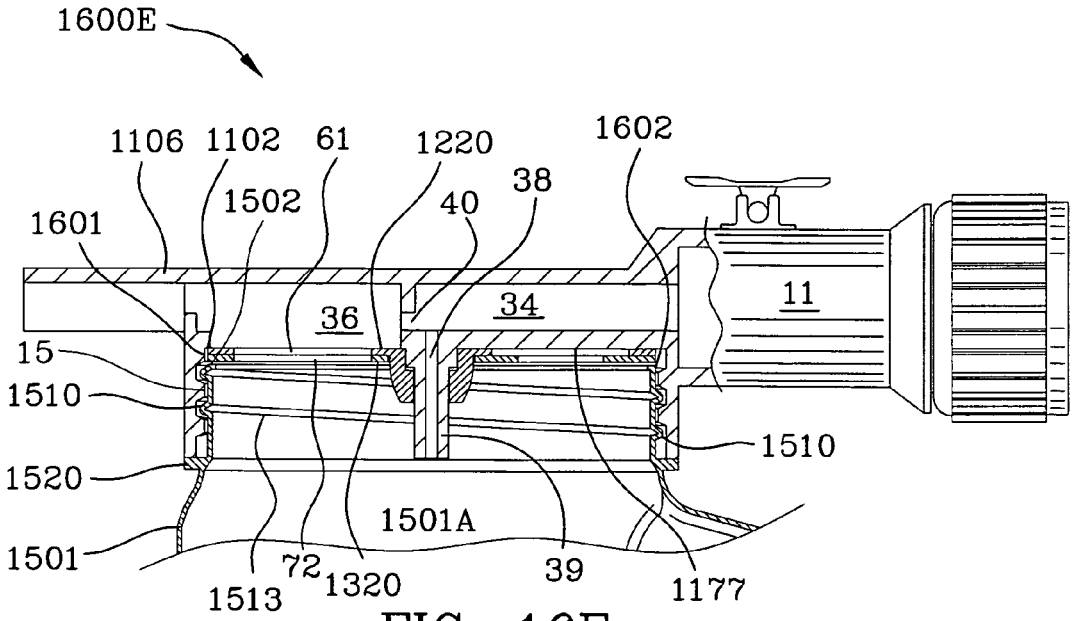
FIG. 16E is a cross-sectional view similar to FIG. 16B of another example of the invention taken along the lines 16B-16B of FIG. 16 with the fixed and rotatable discs mounted into the cap portion of the head of the housing.
Figure 16F:
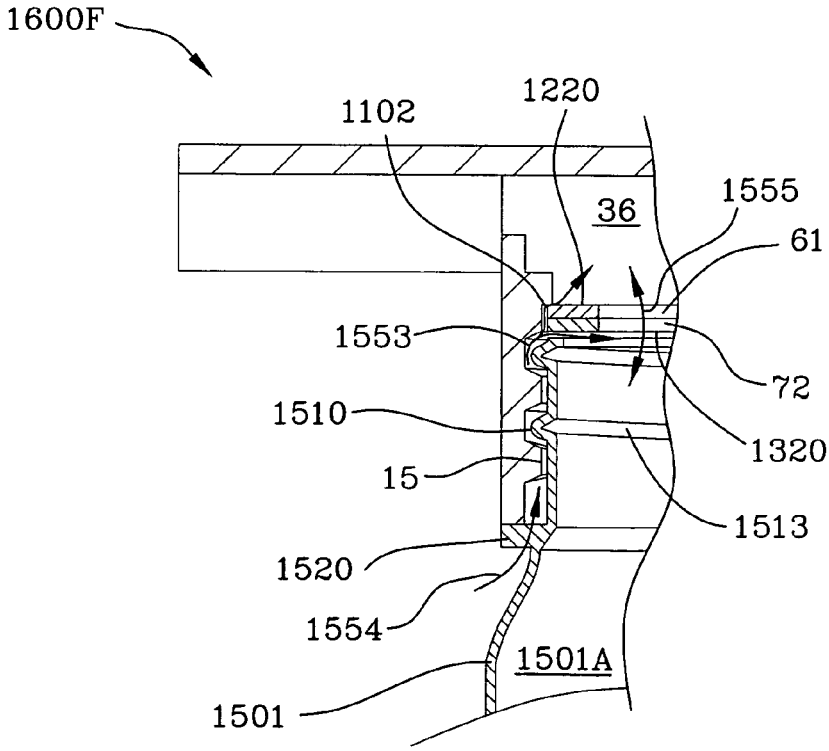
FIG. 16F is an enlargement of a portion of FIG. 16E.

FIG. 16E is a cross-sectional view 1600E similar to FIG. 16B of another example of the invention taken along the lines 16B-16B of FIG. 16 with the fixed 1220 and rotatable 1230 discs mounted into the cap portion of the head 1103A of the housing. In FIG. 16E the depth of the cap portion of the housing is different than the depth of the cap portion of the housing in FIG. 16B to accommodate for the discs 1220, 1230. FIG. 16E illustrates gaps 1601, 1602 between the lip of the bottle 1502 and the rotatable disc 1320. These gaps allow the ingress of air as indicated by flow arrows 1554 and 1553 in FIG. 16F. Air also passes between plate 1220 and lip 1102. FIG. 16F is an enlargement of a portion of FIG. 16E. FIG. 16F illustrates as indicated by reference numeral 1555 that air is aspirated above and below the discs 1220, 1320 and that air and/or a mixture of air and water is exchanged between the mixing chamber and the reservoir depending on volumetric fluid flow and pressure through the elongate passageway, the nature of the fluids and or mixture of fluids and solids to be conveyed from the reservoir and other parameters.

Figure 16G:
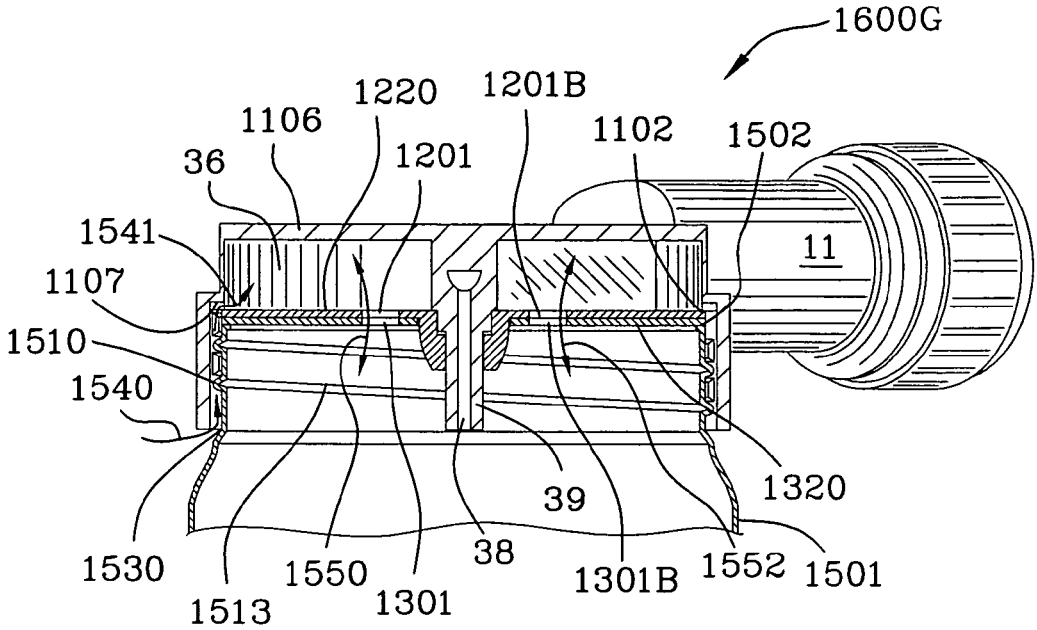
FIG. 16G is a cross-sectional view similar to FIG. 16C of another example of the invention taken along the lines 16C-16C of FIG. 16 with the fixed and rotatable discs mounted into the cap portion of the head of the housing.
Figure 16H:
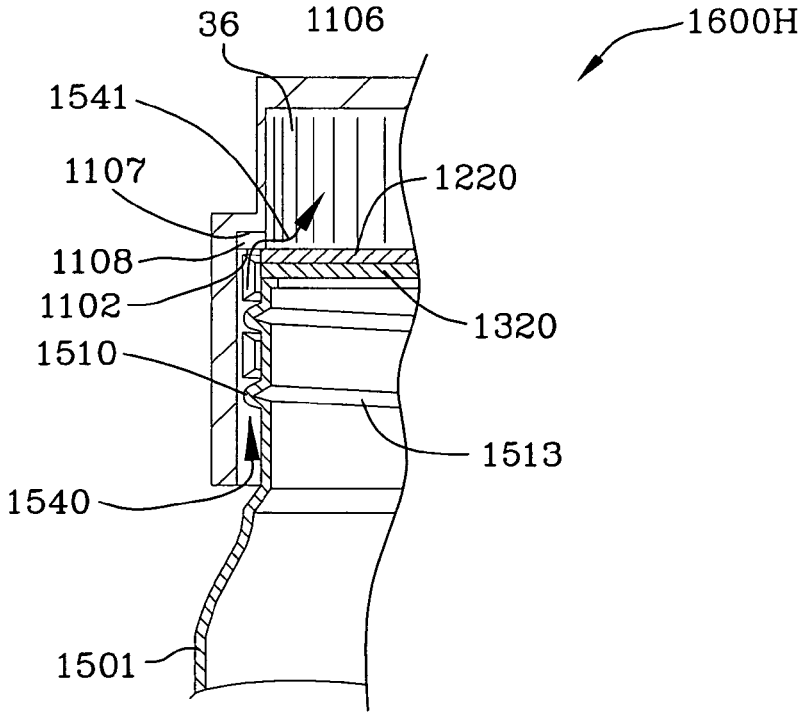
FIG. 16H is an enlargement of a portion of FIG. 16G.

FIG. 16G is a cross-sectional view 1600G similar to FIG. 16C of another example of the invention taken along the lines 16C-16C of FIG. 16 with the fixed 1220 and rotatable 1320 discs mounted into the cap portion of the head 1103A of the housing. In FIG. 16G the depth of the cap portion of the housing is different than the depth of the cap portion of the housing in FIG. 16C. In the example of FIG. 16G, however, no partial shoulder on the bottle (reservoir) is being used. As such, the bottle may be over-tightened and the disc 1320 presses against disc 1220 to secure same to lip 1102. In this example, even if the bottle is over-tightened, aspiration of air to the head portion 1103A of the cap of the housing is facilitated as air easily travels along elongated slots 1101A into notches 1107 and past the discs 1320, 1220. The cross-sectional views illustrated in FIGS. 16G and 16H are taken through the elongated slots 1101A. Therefore, even if provision is not made for one or more stops as has been described herein, provision is made for unimpeded airflow via extended flats in the cap portion of the housing in the event the bottle is accidentally or even intentionally over-tightened. Flow arrows 1550, 1552 indicate an exchange or aspiration of air between the head 1103A and the reservoir. As used herein "exchange" means aspiration. FIG. 16H is an enlargement of a portion of FIG. 16G and notch 1107 in lip 1102 is viewed with the flow of air past the discs indicated by flow arrow 1541.

Figure 17:
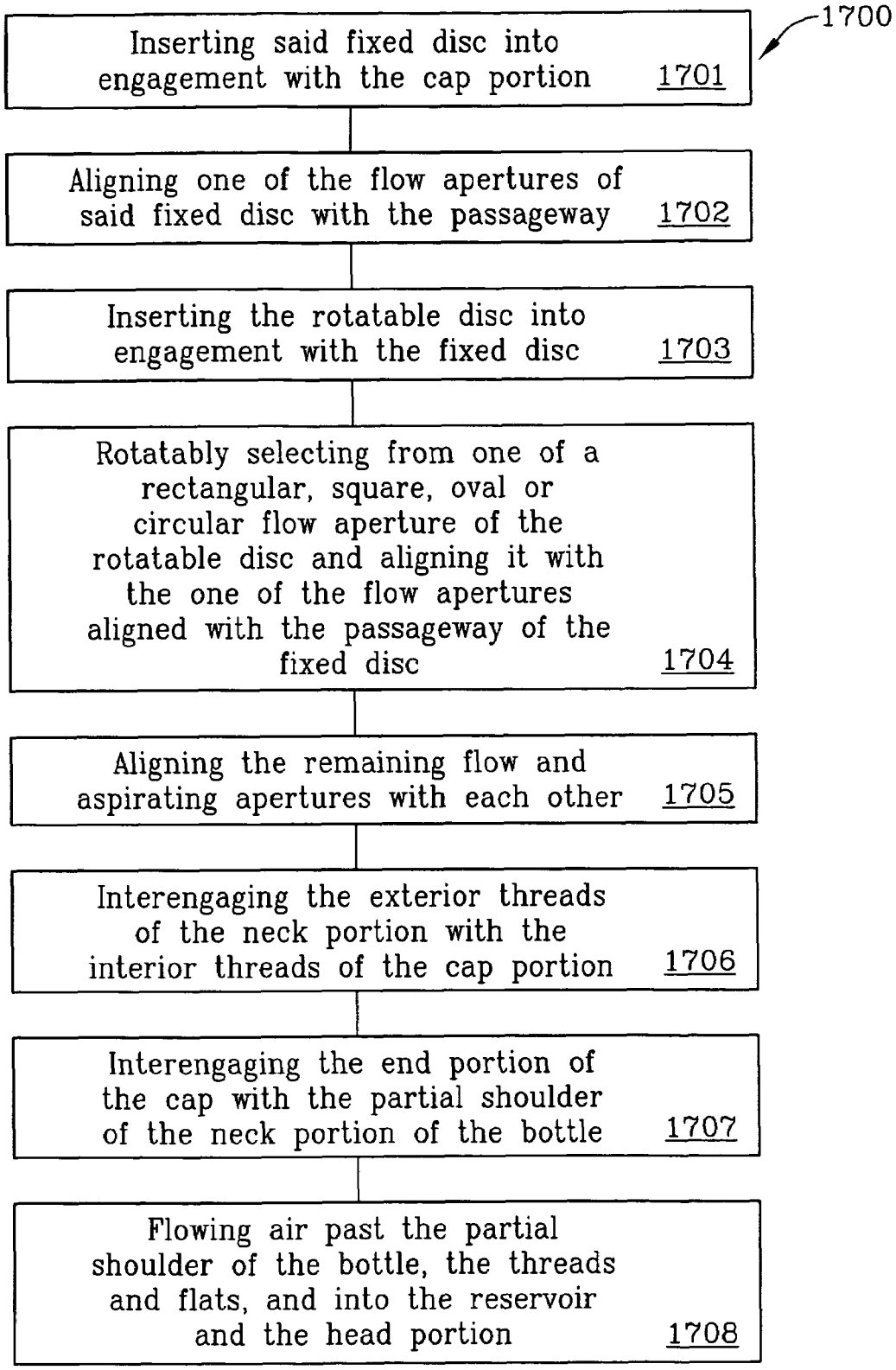
FIG. 17 is a schematic diagram of the process steps for using the improved reservoir and spray applicator.

FIG. 17 is a schematic diagram 1700 of the process steps for using the improved reservoir and spray applicator. A process for aspirating a bottle and spray applicator wherein the bottle includes a neck portion having exterior threads thereon, an end portion and a partial shoulder thereon is disclosed herein. The spray applicator includes a housing, the housing includes a cap portion, the cap portion includes interior threads having flats therein, a passageway, a head portion, an end portion, and a lip. A fixed disc having a plurality of flow apertures and aspirating apertures is employed in the process as is a rotatable disc having a plurality of flow apertures and aspiration apertures.

The steps of the process include: inserting the fixed disc into engagement with the cap portion-1701; aligning one of the flow apertures of the fixed disc with the passageway-1702; inserting the rotatable disc into engagement with the fixed disc-1703; rotatably selecting from one of a rectangular, square, oval or circular flow aperture of the rotatable disc and aligning it with the one of the flow apertures aligned with the passageway of the fixed disc-1704; aligning the remaining flow and aspirating apertures with each other-1705; interengaging the exterior threads of the neck portion with the interior threads of the cap portion-1706; interengaging the end portion of the cap with the partial shoulder of the neck portion of the bottle-1707; and, flowing air past the partial shoulder of the bottle, the threads and flats, and into the reservoir and the head portion-1708. Alternatively, the flats 1001A in the threads of the cap portion of the housing extend past the lip so as to provide an airflow path above the fixed disc.

LIST OF REFERENCE NUMERALS

A-inlet region
B-distribution region
C-mixing region
CL-longitudinal axis
D-exhaust end region
E-direction
F-direction
H-plane
10-convertible spray nozzle apparatus
11-housing
16-canister or jar
18-garden hose
12-internally threaded nut 22
14-rim
14A-inner portion of rim
15-threads
16-reservoir
20-valve
22-internally threaded nut
23-ridge
24-O-ring pair
25-pair of circumferential grooves
26-plunger
27-recess
28-O-ring 28
29-circumferential groove
30-trigger
32-primary inlet chamber 32 of housing 11
34-secondary inlet chamber
36-mixing chamber
38-fill passage 38
39-fill passage wall
40-direct passage
42-chamber walls
50-outlet channel
52-outlet channel deflector surface 52
54-slurry communicating passage
60-stationary disc
61-output orifice
62-mushroomed center
63-retainer ridge
64-orientation clearance
66-integral socket
68-positioning holes
70-moveable disc
72, 72A, 72B-outflow orifices
74-dimples
76-tabs
78-frictional surface
80-flared nose
82-guide ribs 82
84-bottom surface
900-prior art Miracle Gro® spray applicator
901-spray housing
902-thick and rigid plastic bottle
903-inlet
904-outlet
905-interior wall of spray applicator
906-neck of bottle 902
907-internal threads
908-exterior threads
909, 910, 911-walls of spray applicator
1000-enlarged cutaway view of prior art spray applicator
1100-interior view of prior art spray applicator
1100A-interior view of cap portion of housing of spray applicator with extended flats
1100B-interior view of spray applicator with fixed and adjustable discs
1100C-interior view of spray applicator with extended flats and with fixed and adjustable discs
1101-flats
1101A-extended flats
1102-lip in the spray applicator
1103-interior of the upper portion of the spray applicator
1103A-head portion of the cap portion of the spray applicator
1105-bottom lip of spray applicator
1106-outer top of spray applicator
1107-notch in lip 1102
1108-wall forming notch in lip 1102
1109-male protrusion for interengagement with socket 1109
1120-interior wall of spray applicator
1177-enclosed elongate passageway
1199-cap portion of housing
1200-example of fixed disc of the invention
1201-first cylindrically shaped aspirating aperture in the fixed disc
1201A-second cylindrically shaped a aspirating aperture in the fixed disc
1201B-third cylindrically shaped aspirating aperture in the fixed disc
1201C-fourth cylindrically shaped aspirating aperture in the fixed disc
1202-second rectangular aperture in the fixed disc
1203-third rectangular aperture in the fixed disc
1204-fourth rectangular aperture in the fixed disc
1220-fixed disc
1277-crowned or mushroomed center
1300-example of adjustable disc of the invention
1300A-another example of an adjustable disc of the invention
1301-first cylindrically shaped aspirating aperture in the adjustable disc
1301A-second cylindrically shaped aspirating aperture in the adjustable disc
1301B-third cylindrically shaped aspirating aperture in the adjustable disc
1301C-fourth cylindrically shaped aspirating aperture in the adjustable disc
1310-first chord of adjustable disc
1310A-second chord of adjustable disc
1310B-third chord of adjustable disc
1310C-fourth chord of adjustable disc

1311-first arc of adjustable disc
1311A-second arc of adjustable disc
1311B-third arc of adjustable disc
1311C-fourth arc of adjustable disc
1312-wall of notch in adjustable disc
1313-notch in adjustable disc
1320-adjustable disc
1320A-surface of adjustable disc 1320
1321-adjustable disc
1400-perspective view along the line 14-14 of FIGS. 11 and 11B
1400A-cross-sectional view along the line 14-14 of FIGS. 11 and 11B
1400B-perspective view along the line 14B-14B of FIGS. 11A and 11C
1400C-cross-sectional view along the line 14B-14B of FIGS. 11A and 11C.
1401-gap between wall 14A and discs 1220, 1320
1430-air flow arrow
1440-air flow arrow
1500-top view of bottle holding soluble/insoluble substances
1500A-side view of bottle
1500B-side view of bottle having flats in threads of bottle
1501-wall of bottle
1501A-interior of bottle
1502-top lip of bottle
1503-neck of bottle
1510-exterior threads on neck of bottle
1513-interior indentations forming exterior threads on neck of bottle
1520-stop
1530-flat on exterior of bottle between stops 1520
1540-air flow arrow
1541-air flow arrow
1550-air flow arrow
1552-air flow arrow
1553-air flow arrow
1554-air flow arrow
1555-air flow arrow
1583-flats in bottle threads
1600-top view of the spray applicator and the bottle
1600A-front side view of the spray applicator and the bottle
1600B-cross-sectional view of the spray applicator and the bottle taken along the lines 16B-16B of FIG. 16.
1600C-cross-sectional view of the spray applicator and the bottle taken along the lines 16C-16C of FIG. 16.
1600D-enlarged portion of FIG. 16C
1601, 1602-gap between top of bottle 1502 and lip 1102
1683-indicia on cap portion
1684-indicia on container portion
1700-process for aspirating a bottle and spray applicator
1701-inserting the fixed disc into engagement with the cap portion
1702-aligning one of the flow apertures of the fixed disc with the passageway
1703-inserting the rotatable disc into engagement with the fixed disc
1704-rotatably selecting from one of a rectangular, square, oval or circular flow aperture of the rotatable disc and aligning it with the one of the flow apertures aligned with the passageway of the fixed disc
1705-aligning the remaining flow and aspirating apertures with each other
1706-interengaging the exterior threads of the neck portion with the interior threads of the cap portion
1707-interengaging the end portion of the cap with the partial shoulder of the neck portion of the bottle
1708-flowing air past the partial shoulder of the bottle, the threads and flats, and into the reservoir and the head portion The invention has been set forth by way of example only. Those skilled in the art will readily recognize that changes may be made to the invention as described herein without departing from the spirit and scope of the invention as set forth below in the Claims.

The invention claimed is:

1. An apparatus for spraying lawn products adapted for use with a fluid supply source and a reservoir holding said lawn products, comprising:

a housing defining a mixing chamber therein;

said reservoir coupled to said housing;

a fluid supply source communicating a supply of a first fluid from the fluid supply source into the housing through an elongate passageway;

a first passageway for communicating a first portion of the first fluid from the fluid supply source into the reservoir as a mixing fluid flow;

a second passageway communicating the remaining portion of the first fluid from the fluid supply source into the mixing chamber;

said housing includes a substantially cylindrically shaped cap portion having discontinuous internal threads forming flats therein, a lip portion, and an open end portion;

said reservoir includes a generally cylindrically shaped neck portion having a partial exterior shoulder, external threads thereon, and an end portion;

said internal threads of said generally cylindrically shaped neck portion of said reservoir interengaging said discontinuous internal threads having flats therein of said substantially cylindrically shaped cap portion;

a fixed disc mounted to said cylindrically shaped cap portion of said housing; said fixed disc comprising a plurality of rectangularly shaped flow apertures; said fixed disc in loose engagement with said lip of said cap portion of said housing; one of said rectangularly shaped apertures communicates with said mixing chamber; said fixed disc further includes four circularly shaped aspirating apertures which communicate with a head portion of said housing; a rotatably adjustable disc in loose engagement with said fixed disc; said rotatably adjustable disc includes a rectangularly shaped-mixing flow aperture, a square shaped mixing flow aperture, an oval shaped mixing flow aperture and a circularly shaped mixing flow aperture any one of which may be selectively aligned with said one of said rectangularly shaped apertures communicating with said mixing chamber, the remaining apertures not aligned with said mixing chamber being aligned with said rectangular apertures of said fixed disc such that two of said remaining apertures communicate with said head of said housing; and, said rotatably adjustable disc further includes four circularly shaped aspirating apertures which align with said four circularly shaped aspirating apertures of said fixed disc; said flow apertures of said fixed and rotatable discs aligning with said mixing chamber control flow therethrough and said flow control apertures not aligned with said mixing chamber and said aspirating apertures aligned with each other aspirate said head of said housing and said reservoir; and, said partial exterior shoulder of said generally cylindrically shaped neck portion of said reservoir interengaging said open end portion of said substantially cylindrically shaped cap portion such that said end portion of said neck portion of said reservoir does not engage said fixed and rotatable discs or said lip portion of said substantially shaped cap portion enabling aspiration of said reservoir and said head portion of said cap portion of said housing past said partial shoulder, said threads of said housing and reservoir, said fixed and rotatable discs, and said flats of said housing.

2. A bottle and spray applicator, comprising:

said spray applicator includes a housing;

said housing includes a head and a passageway through said housing;

said bottle includes a stop;

said housing being threadedly interconnected with said bottle and interengages said stop on said bottle such that air may flow past said stop and said threaded interconnection and into said head of said housing and said bottle;

a fixed disc having four rectangular orifices located 90° apart;

any one of said four rectangular orifices of said fixed disc positioned adjacent said passageway;

two of said four rectangularly shaped orifices in communication with said head of said housing;

said fixed disc includes a plurality of circularly shaped orifices in communication with said head of said housing;

a selectively rotatable disc adjacent said stationary disc;

said rotatable disc includes a plurality of flow control orifices any one of which may be selectively aligned with said any one of said four rectangularly shaped orifices of said fixed disc adjacent said passageway so as to control flow through said passageway;

two of said flow control orifices of said rotatable disc being aligned with two of said rectangularly shaped discs for communication of air to and from said head; and, said rotatable disc further includes a plurality of circularly shaped apertures in alignment with said circularly shaped apertures of said fixed disc for communication of air to and from said head.

3. A bottle and spray applicator as claimed in claim 2 wherein said bottle includes discontinuous threads having flats.

4. A process for aspirating a bottle and spray applicator, said bottle includes a neck portion having exterior threads thereon, an end portion and a partial shoulder thereon, said spray applicator includes a housing, said housing includes a cap portion, said cap portion includes interior threads having flats therein, a passageway, a head portion, an end portion, a lip, a fixed disc having a plurality of flow apertures and aspirating apertures, a rotatable disc having a plurality of flow apertures and aspiration apertures, comprising the steps of:

inserting said fixed disc into engagement with said cap portion;

aligning one of said flow apertures of said fixed disc with said passageway;

inserting said rotatable disc into engagement with said fixed disc;

rotatably selecting from one of a rectangular, square, oval or circular flow aperture of said rotatable disc and aligning it with said one of said flow apertures aligned with said passageway of said fixed disc, and, aligning the remaining flow and aspirating apertures with each other;

interengaging said exterior threads of said neck portion with said interior threads of said cap portion;

interengaging said end portion of said cap with said partial shoulder of said neck portion of said bottle; and, flowing air past said partial shoulder of said bottle, said threads and flats, and into said reservoir and said head portion.

5. A process for aspirating a bottle and spray applicator, said bottle includes a neck portion having exterior threads thereon, an end portion and a partial shoulder thereon, said spray applicator includes a housing, said housing includes a cap portion, said cap portion includes interior threads having flats therein, a passageway, a head portion, an end portion, a lip, a fixed disc having a plurality of flow apertures and aspirating apertures, a rotatable disc having a plurality of flow apertures and aspiration apertures, as claimed in claim 4 wherein the flats in the threads of the cap portion of the housing extend past said lip so as to provide an airflow path above said fixed disc.

6. A process for aspirating a bottle and spray applicator, said bottle includes a neck portion having exterior threads thereon, an end portion and a partial shoulder thereon, said spray applicator includes a housing, said housing includes a cap portion, said cap portion includes interior threads having flats therein, a passageway, a head portion, an end portion, a lip, a fixed disc having a plurality of flow apertures and aspirating apertures, a rotatable disc having a plurality of flow apertures and aspiration apertures, as claimed in claim 5, further comprising the step of aligning said cap portion and said reservoir using indicia.

* * * * *